US007988072B2

(12) United States Patent
Miller et al.

(10) Patent No.: US 7,988,072 B2
(45) Date of Patent: Aug. 2, 2011

(54) WATER SPRINKLER WITH WATER MOTOR

(75) Inventors: David W. Miller, Fairhope, PA (US); Doug Shaulis, Somerset, PA (US)

(73) Assignee: Robert Bosch GmbH, Stuttgart (DE)

( * ) Notice: Subject to any disclaimer, the term of this patent is extended or adjusted under 35 U.S.C. 154(b) by 233 days.

(21) Appl. No.: 12/241,865

(22) Filed: Sep. 30, 2008

(65) Prior Publication Data

US 2010/0078503 A1 Apr. 1, 2010

(51) Int. Cl.
*B05B 3/16* (2006.01)

(52) U.S. Cl. ..... 239/242; 239/237; 239/263.3; 239/239; 239/281

(58) Field of Classification Search ..... 239/242, 239/237, 239, 381, 263.3
See application file for complete search history.

(56) References Cited

U.S. PATENT DOCUMENTS

| | | | | |
|---|---|---|---|---|
| 3,105,639 | A * | 10/1963 | Jepson | 239/242 |
| 3,767,118 | A | 10/1973 | Oberto et al. | |
| 3,829,018 | A | 8/1974 | Oberto | |
| 4,069,976 | A | 1/1978 | Chauvigne | |
| 4,860,954 | A | 8/1989 | Allemann | |
| 5,350,115 | A | 9/1994 | Burnworth et al. | |
| 6,336,597 | B1 * | 1/2002 | Kah, Jr. | 239/242 |
| 7,226,000 | B2 * | 6/2007 | Huang | 239/242 |

* cited by examiner

*Primary Examiner* — Dinh Q Nguyen
(74) *Attorney, Agent, or Firm* — Maginot, Moore & Beck

(57) ABSTRACT

A sprinkler apparatus comprises a water wheel that is configured to be alternatively driven in a first wheel direction by a first fluid flow and a second wheel direction by a second fluid flow. The water wheel drives a water tube having at least one fluid outlet. The water tube is moveable in a first tube direction in response to the water wheel being driven in the first wheel direction, and is further moveable in a second tube direction in response to the water wheel being driven in the second wheel direction. The sprinkler apparatus further comprises a switch wheel positioned to receive an initial fluid flow and generate the first and second fluid flows therefrom. In particular, when the switch wheel is in a first position, the first fluid flow is generated. When the switch wheel is in a second position, the second fluid flow is generated.

18 Claims, 22 Drawing Sheets

WATER SPRINKLER WITH WATER MOTOR

FIELD

This application relates to the field of water sprinklers, and more particularly to oscillating sprinklers.

BACKGROUND

Water sprinklers are commonly used to deliver water to a spray area. Water sprinklers come in many forms including stationary water sprinklers and oscillating water sprinklers. Oscillating water sprinklers include a spray tube or other spray member that oscillates back and forth in order to deliver water to a greater area than would otherwise be possible if the spray member were fixed. Water flow provided to the oscillating sprinkler is typically used to drive a water motor which, in turn, drives the spray member in a repeating manner. When the spray member is driven to a first user defined oscillation point, the direction of the water motor drive is reversed. This change in drive direction reverses the direction of travel of the spray member. The spray member is then driven to a second user defined oscillation point where the drive direction of the water motor is again reversed, thus reversing the direction of travel of the spray member. This oscillating spray pattern continues as long as a flow of water is supplied to the sprinkler.

Various methods have been employed in past sprinklers to oscillate a spray tube. For example, sprinklers utilizing crank style motors oscillate the spray tube using a rocker arm and linkage connected to the crank. User defined stop points of the spray tube are adjusted by turning a knob, which effectively varies the length of the rocker arm. These crank style motors rotate in only one direction, but a significant lag time is experienced between directional changes of the spray tube. One type of motor that addresses this lag time issue is the rotary motor, which reverses direction. With rotary motors, the typical method of switching direction is to use the motor's power to load a spring or combination of springs. The energy of such the spring is released at a given moment in order to move a trip plate and reverse direction of the gear train. One problem with this arrangement is that more and more power is required by the motor as the spring is loaded. Another problem with this arrangement is that the springs often work like sea-saws and, just before they are released, they cross-over a balanced point and have a high potential to end up balanced in the center, pushing on the trip plates equally, and thus leaving the actual switch mechanism in an in-between position. Accordingly, it would be advantageous to provide a mechanism for switching the direction of a water motor which has relatively little lag time, is relatively simple in operation, and is durable with a long life expectancy.

In typical oscillating sprinklers the motor is operably connected to the spray tube such that operation of the motor results in oscillation of the spray tube. However, the spray tube or motor may be easily damaged by over-rotation of the spray tube relative to the motor. Accordingly, it would be desirable to include torque relief between the motor and the spray tube in an oscillating sprinkler. It would be further desirable if such torque relief could be provided with a mechanism that is relatively simply and easy to install in the sprinkler. It would also be desirable if such torque relieve could be provided in a manner that facilitates proper assembly of the spray tube including proper orientation of a spray coverage adjustment mechanism on the sprinkler.

Another problem with traditional oscillating sprinklers is that the adjustment mechanisms used to select a desired spray coverage area can be confusing. For example, with many sprinklers, a trip lever external to the water motor is mechanically and automatically pushed in order to bring about a reverse in direction of the spray tube at a user defined position. This has been accomplished by attaching an adjusting device onto the spray tube and allowing the adjusting device to rotate with the spray tube. The standard convention for this setup is to create a single lever area on each adjusting device and a stationary indicator on the sprinkler motor or base. However, these adjustment mechanisms tend to be confusing to users wishing to change the spray area covered by the sprinkler. For example, in order to increase water coverage to the right, the user must move the left adjusting lever further to the left. This arrangement often seems counter-intuitive to the user, as the user's inclination is typically to move the lever to the right in order to increase spray coverage to the right. Accordingly, it would be advantageous to provide a mechanism for adjusting the desired coverage area on an oscillating sprinkler that can readily understood by the user.

SUMMARY

A sprinkler apparatus comprises a water wheel that is configured to be alternatively driven in a first wheel direction by a first fluid flow and a second wheel direction by a second fluid flow. The water wheel drives a water tube having at least one fluid outlet opening. The water tube is moveable in a first tube direction in response to the water wheel being driven in the first wheel direction, and is further moveable in a second tube direction in response to the water wheel being driven in the second wheel direction. The sprinkler apparatus further comprises a switch wheel that is positioned to receive an initial fluid flow and generate the first fluid flow and the second fluid flow therefrom. When the switch wheel is in a first position, the first fluid flow is generated. When the switch wheel is in a second position, the second fluid flow is generated.

In at least one embodiment, the sprinkler apparatus is an oscillating sprinkler wherein the water tube includes an inlet for receiving the first and second fluid flows and wherein the first and second fluid flows are distributed through the at least one fluid outlet. The sprinkler apparatus may further comprise a catch moveable between a first catch position and a second catch position, wherein the catch is configured to retain the switch wheel in the first position when the catch is in the first catch position and wherein the catch is configured to retain the switch wheel in the second position when the catch is in the second catch position. In such an embodiment, the water wheel may be configured to rotate in opposing directions depending upon the position of the catch. At the same time, the switch wheel may be configured to rotate in the same direction when moving from the first position to the second position as when moving from the second position to the first position.

In at least one embodiment, the switch wheel is provided as a water turbine comprising a plurality of vanes. The switch wheel may be provided in a water motor housing. A partition separates the water wheel from the switch wheel within the housing. The partition includes a first passage and a second passage, wherein the first fluid flow passes through the first passage of the partition and the second fluid flow passes through the second passage of the partition. In this embodiment, the switch wheel may be configured to block fluid from passing through the second passage when the switch wheel is in the first position and further configured to block fluid from passing through the first passage when the switch wheel is in the second position.

The above described features and advantages, as well as others, will become more readily apparent to those of ordinary skill in the art by reference to the following detailed description and accompanying drawings. While it would be desirable to provide a sprinkler that provides one or more of the foregoing or other advantageous features as may be apparent to those reviewing this disclosure, the teachings disclosed herein extend to those embodiments which fall within the scope of the appended claims, regardless of whether they accomplish one or more of these advantages or include one or more of these advantageous features.

DESCRIPTION

Figure 1:
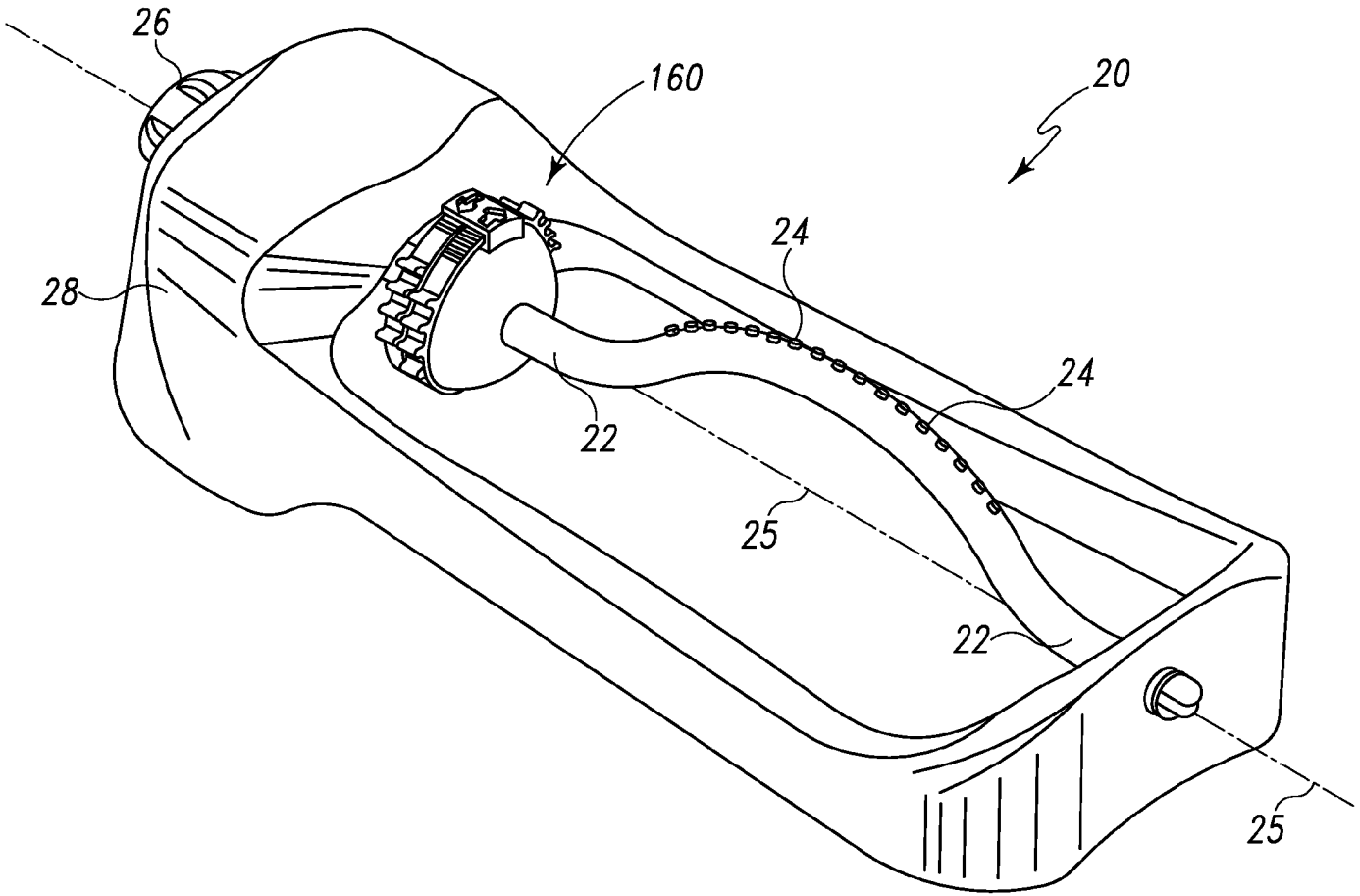
FIG. 1 shows a perspective view of one embodiment of a water sprinkler with a water motor and spray adjustment mechanism.

With reference to the embodiment shown in FIG. 1, a sprinkler 20 comprises a water spray tube 22 configured to receive a flow of water or other fluid and spray the water from outlets 24 in the spray tube 22. The spray tube 22 is configured to rotate back and forth in a repeating fashion about axis 25 such that the water spray from the sprinkler tube 22 is delivered to a spray area. The terms "water" and "fluid" as used herein are intended to encompass any liquid that is sprayed from a sprinkler.

The spray tube 22 is driven by a water motor 30 (not shown in FIG. 1; see FIG. 2) located within the sprinkler housing 28. The water motor 30 is powered by a flow of water received at the water hose inlet 26. The flow of water that powers the water motor 30 within the housing 28 is passed from the water motor 30 to the spray tube 22. The water powered motor 30 provides the power to oscillate the spray tube 22 back and forth. At the end of each oscillation, the spray tube 22 changes direction and rotates in the opposite direction. A clutch mechanism (not shown in FIG. 1; see FIG. 11) which acts as a torque limiter is provided between the water motor 30 and the spray tube 22. A spray area adjustment mechanism 160 is also provided on the sprinkler, allowing a user to easily change the spray area covered by the sprinkler. The spray area adjustment mechanism 160 includes indicia that readily communicate the selected spray area to the user.

Water Motor With Switch Wheel

Figure 2:
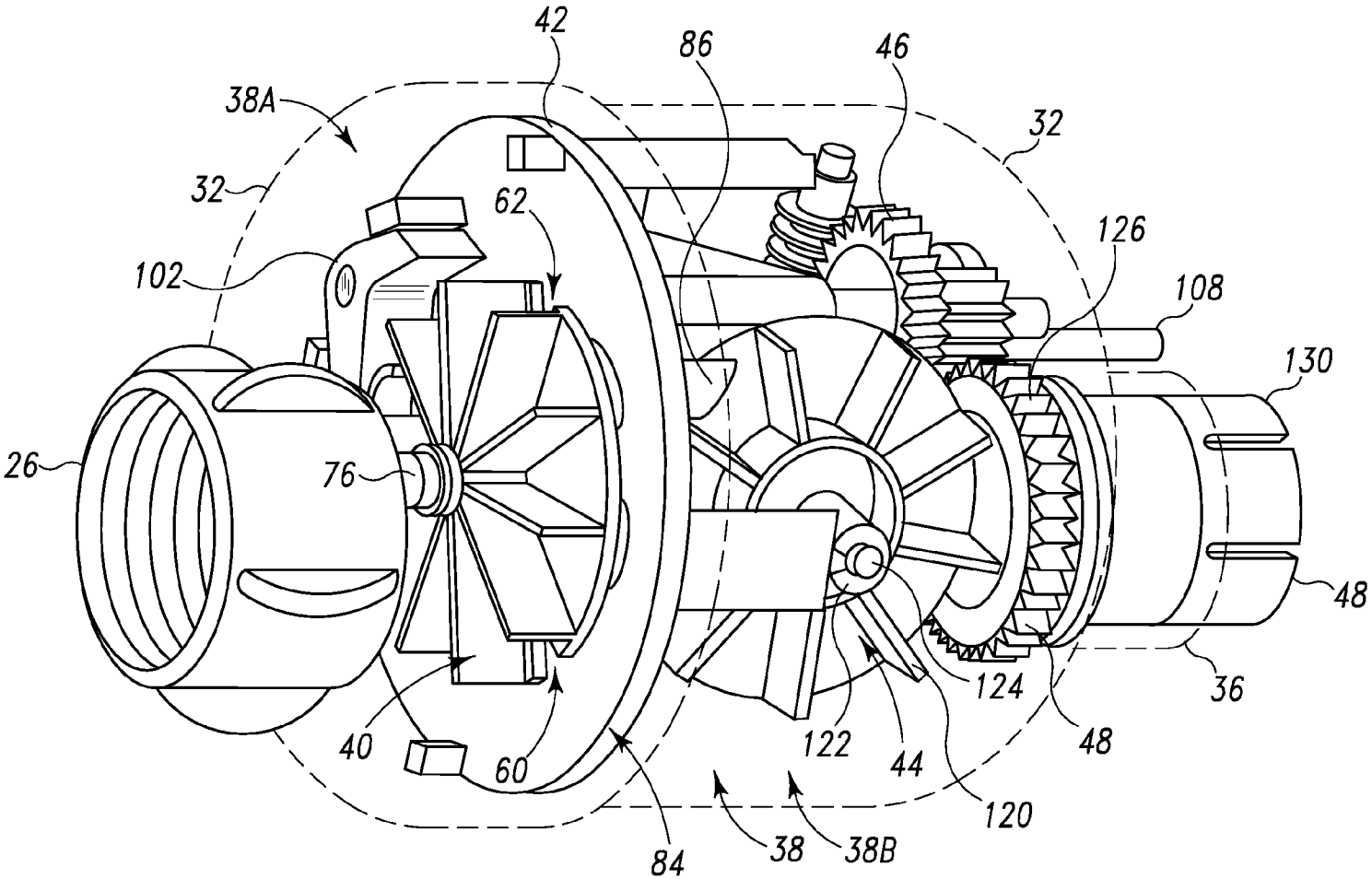
FIG. 2 shows a perspective see-through view of the water motor used with the water sprinkler of FIG. 1.
Figure 3:
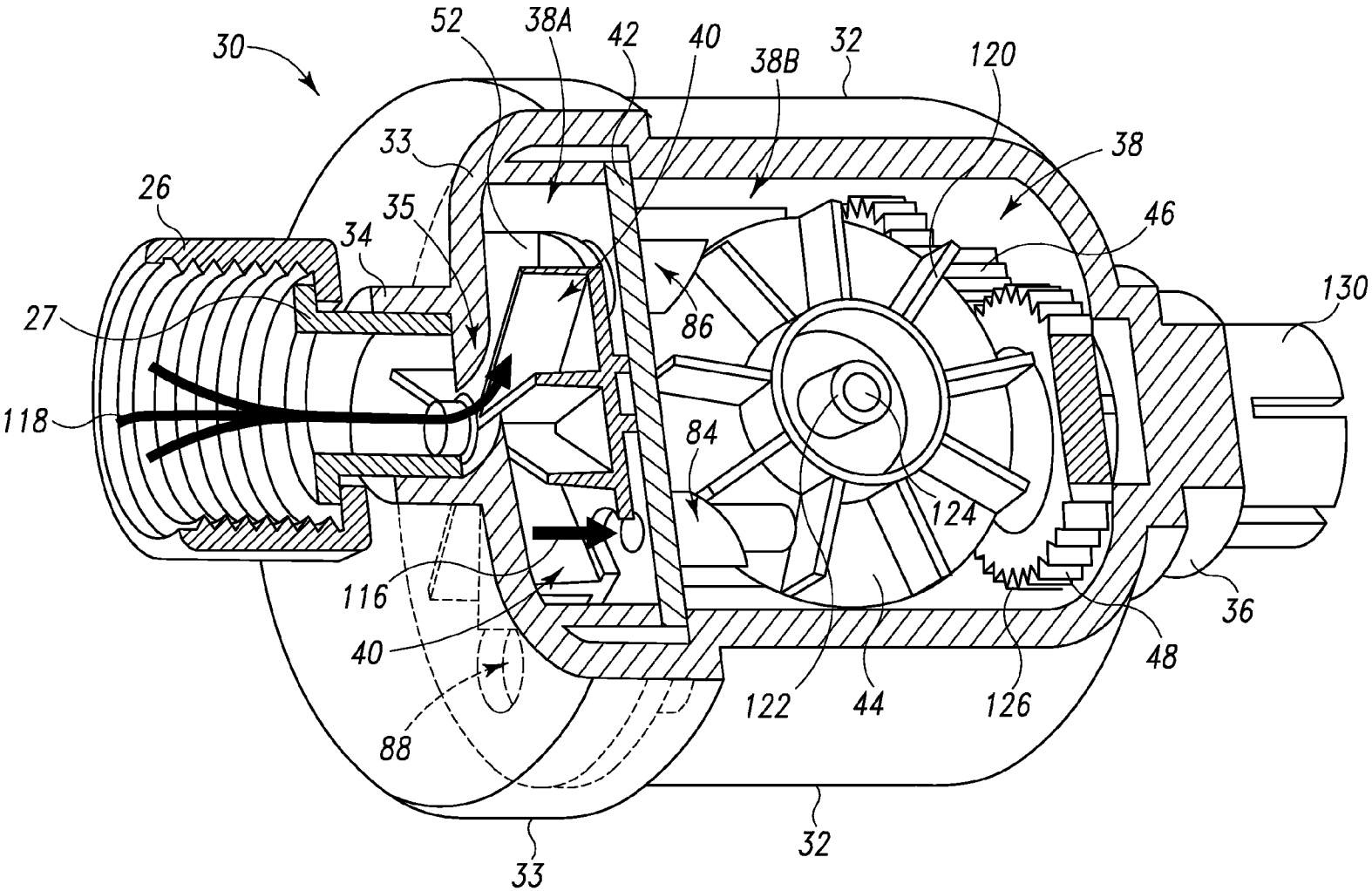
FIG. 3 shows a perspective cutaway view of the water motor of FIG. 2.

With reference now to FIGS. 2-3, the water motor 30 powers movement of the spray tube 22. The water motor 30 comprises a motor housing 32 that defines a water inlet 34, a water outlet 36 and an interior chamber 38 provided between the water inlet 34 and the water outlet 36. A switch wheel 40, a switch plate 42, a water wheel 44, and a drive train 46 with an output gear 48 are all provided within the interior chamber 38. As explained in further detail below, water flow through the housing 32 and into the spray tube 22 drives the output gear 48 in either a forward direction or a reverse direction. The output gear 48 is then used to drive the spray tube 22 in an oscillating fashion. The components of the water motor 30 are generally made of a relatively strong material that will not corrode with prolonged exposure to water, such as a polyvinyl chloride or other polymer material.

Figure 4:
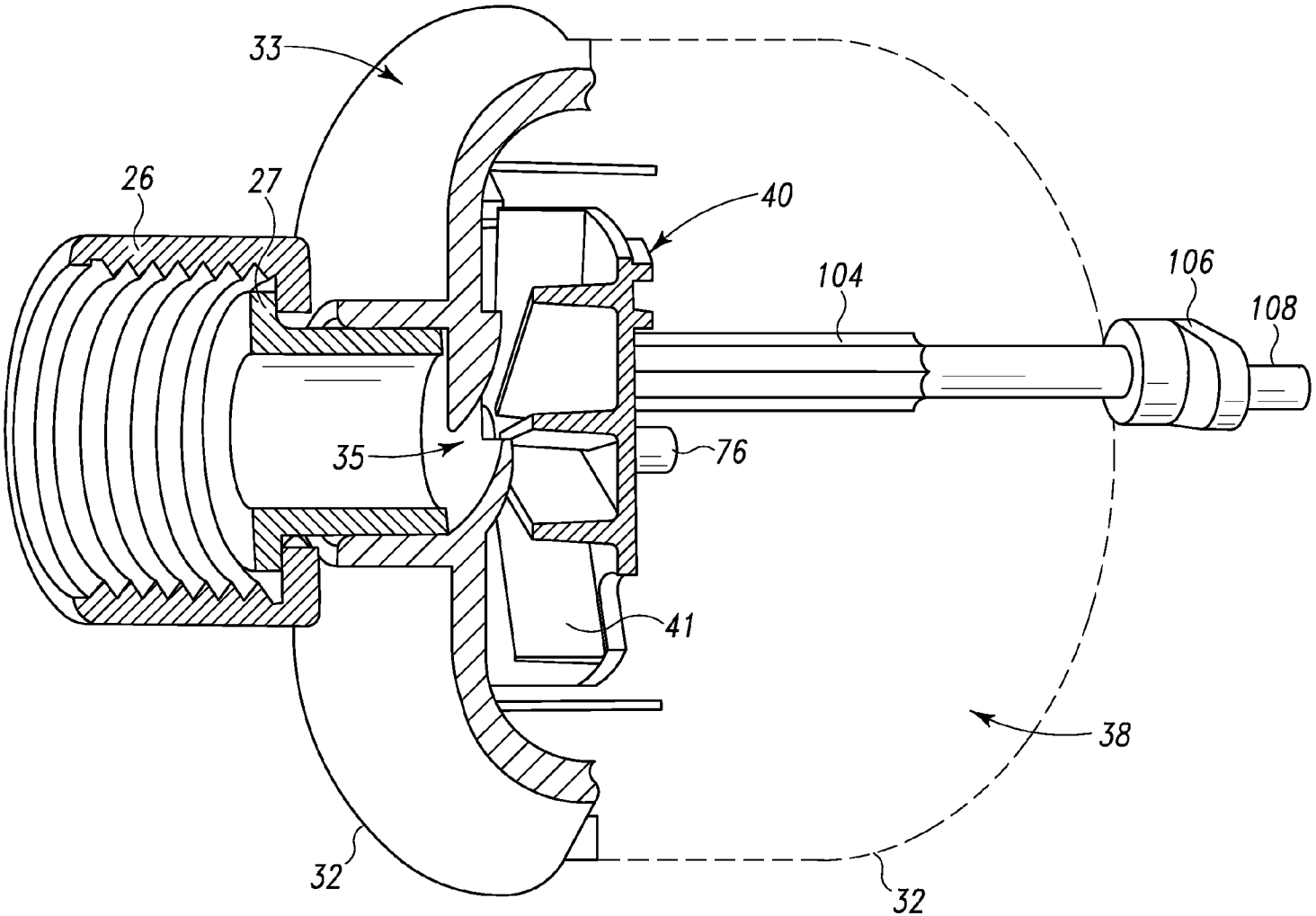
FIG. 4 shows a cutaway view of the water inlet and switch wheel of the water motor of FIG. 2.

The hose inlet 26 is configured for connection to a water source, such as a garden hose. The hose inlet 26 leads to the water inlet 34 of the motor housing through a connecting member 27. The water inlet 34 is provided in an end cap 33 of the motor housing. The end cap 33 also defines a directional channel 35. Water from the water source passes through the hose inlet 26 and the water motor inlet 34 and is directed to the switch wheel 40 by the directional channel 35. As best seen in FIG. 4, the directional channel 35 is shaped such that water passing through the channel 35 always flows in the same direction, encouraging the switch wheel 40 in a counterclockwise direction, as suggested by arrow 41.

Figure 5A:
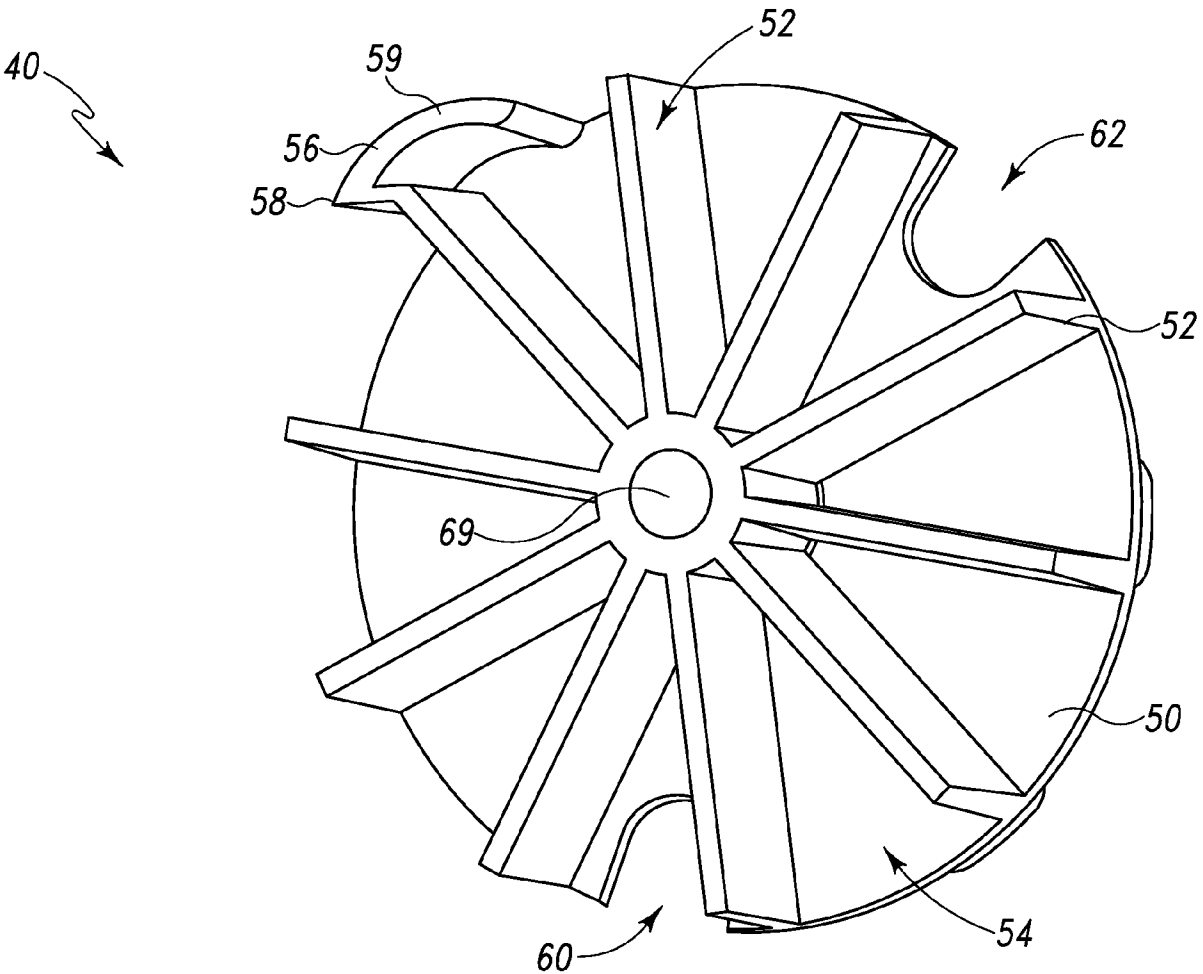
FIG. 5A shows a front perspective view of the switch wheel of FIG. 2.
Figure 5B:
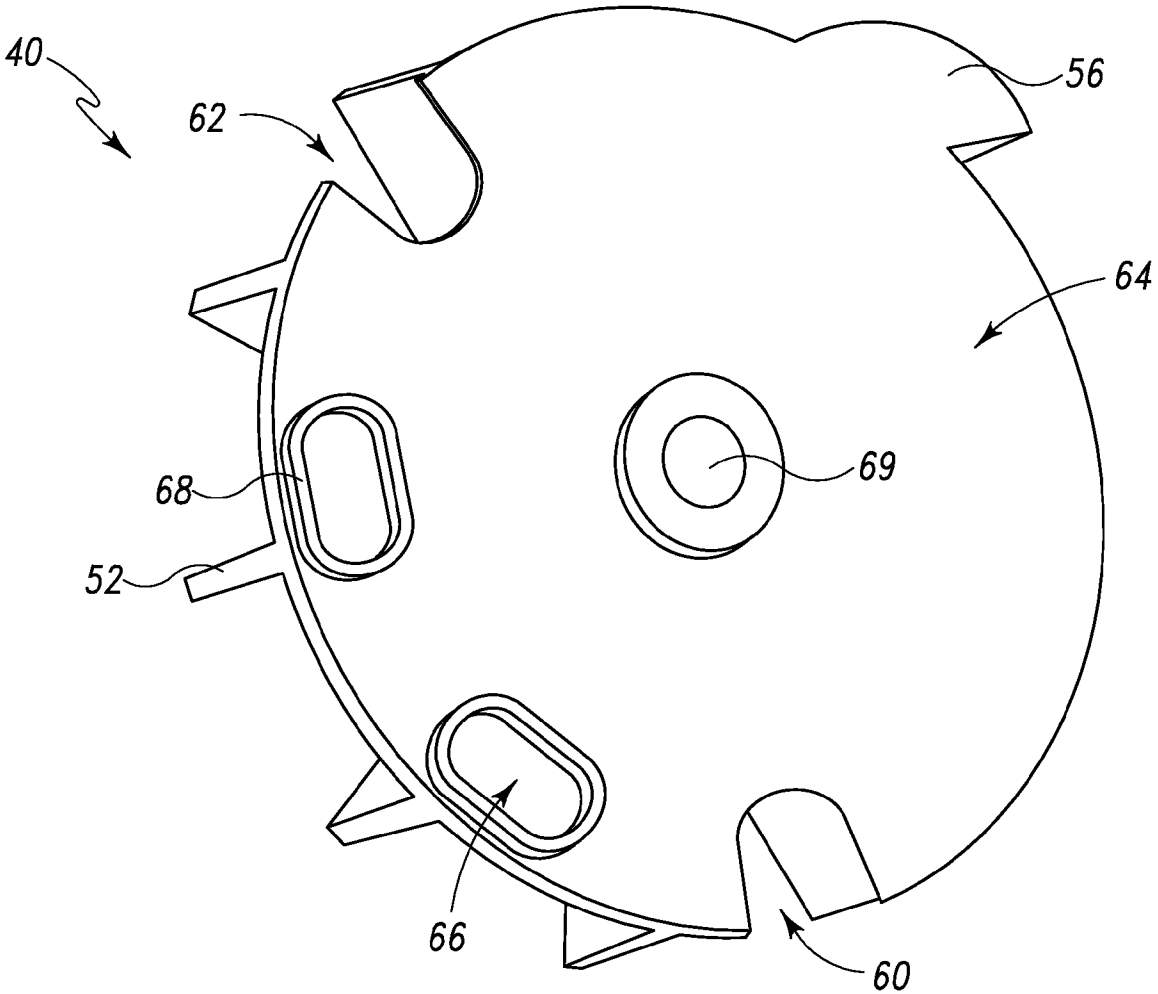
FIG. 5B shows a rear perspective view of the switch wheel of FIG. 5A.

FIGS. 5A and 5B show one embodiment of the switch wheel 40. As shown in FIG. 5A, the switch wheel is provided in the form of a turbine comprising a circular plate 50 with a plurality of fins 52 positioned on the plate. The fins 52 are provided on a forward side 54 of the plate 50 and are configured to be driven by incoming water to encourage rotation of the switch wheel 40. The switch wheel 40 also includes a stop member 56. The stop member 56 is provided as an extended fin which leads to a point 58 with a tail portion 59 trailing the point 58. The stop member 56 is used to stop rotation of the switch wheel 40 at selective locations in order to allow the first flow or the second flow of water through the switch wheel 40 and switch plate 42.

The forward side 54 switch wheel 40 also includes a first opening 60 and a second opening 62 in the plate 50. As explained in further detail below, the first opening 60 and the second opening 62 provide passages through the switch wheel. These passages lead to respective ports 84, 86 in the switch plate 42 when the switch wheel 40 properly positioned, and thus provide for either a first flow of water or a second flow of water to flow through the switch plate 42.

As shown in FIG. 5B, the reverse side 64 of the switch wheel 40 includes a first pad 66 and a second pad 68. These pads 66, 68 protrude from the surface of the reverse side 64 of the switch wheel. As explained in further detail below, these pads 66, 68 selectively cover ports 84, 86 in the switch plate 42 in order to block the first flow or second flow of water from passing through the switch plate 42.

Figure 6A:
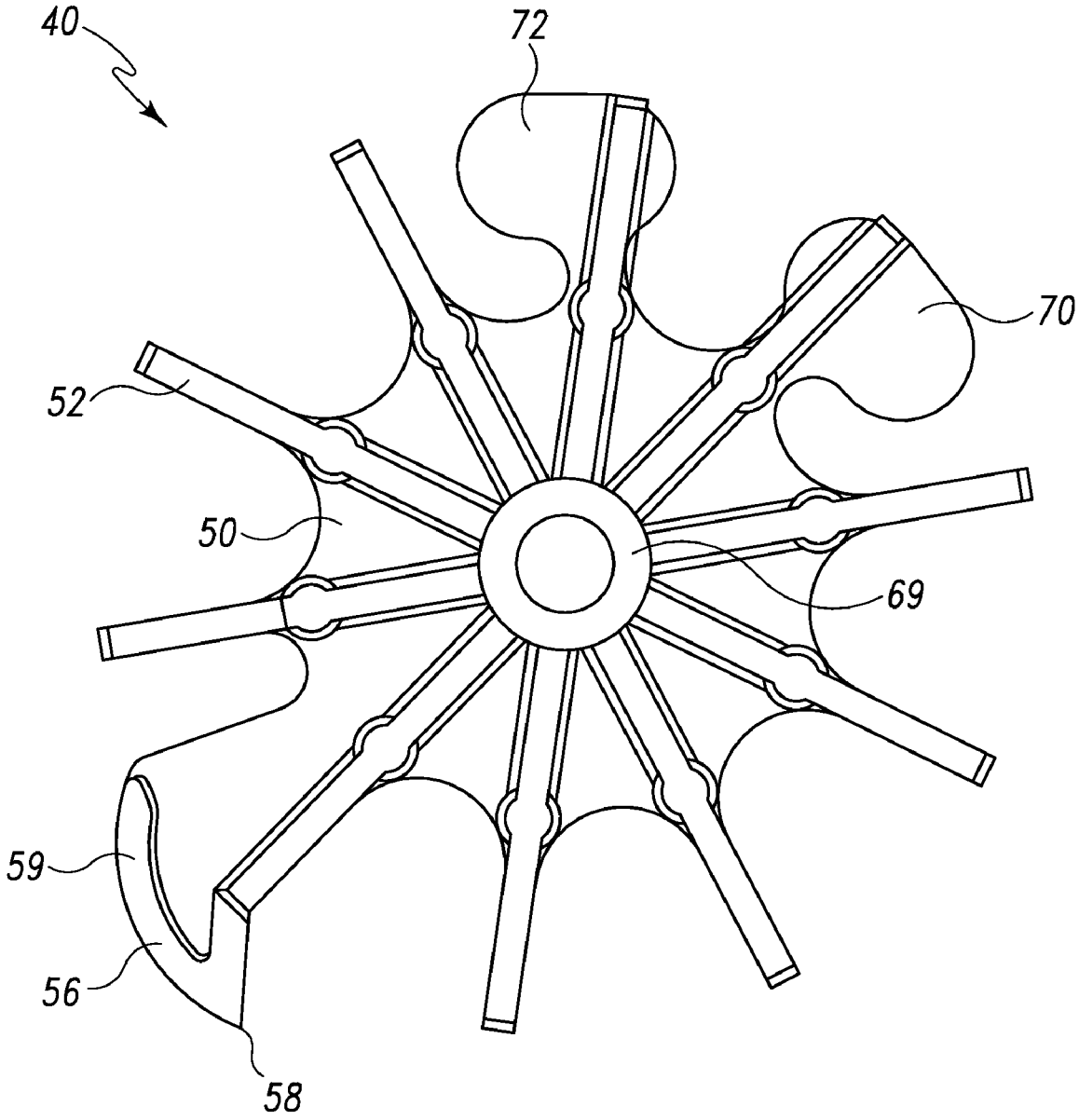
FIG. 6A shows a front view of an alternative embodiment of the switch wheel of FIG. 5A.
Figure 6B:
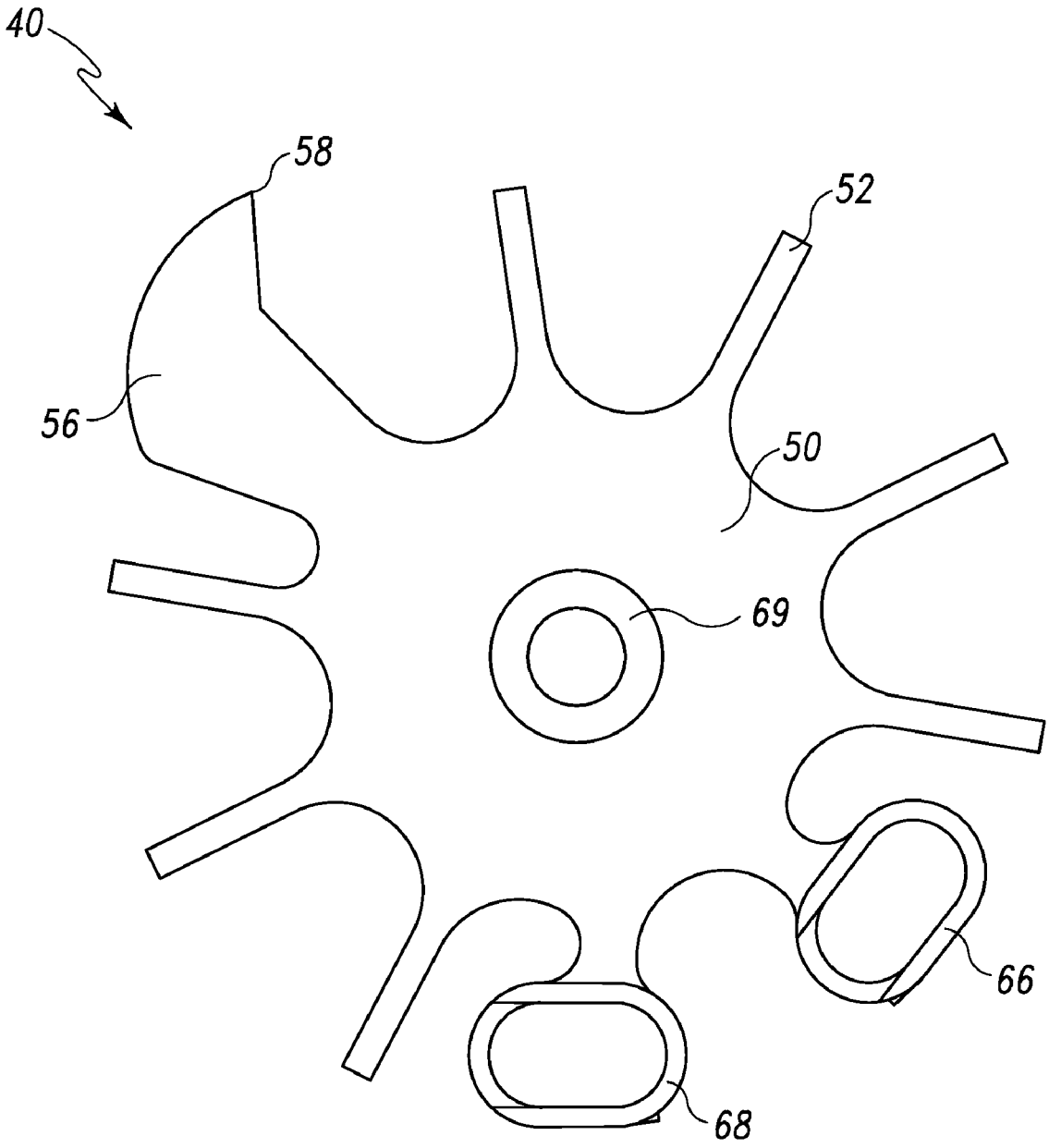
FIG. 6B shows a rear view of the alternative embodiment of the switch wheel of FIG. 6A.

An alternative embodiment of the switch wheel 40 is shown in FIGS. 6A and 6B. In this embodiment, the switch wheel is also provided as a turbine with a plurality of fins 52. However, the plate portion 50 of the switch wheel 40 in the embodiment of FIGS. 6A and 6B is significantly smaller than that of FIGS. 5A and 5B, with the fins 52 in the embodiment of FIGS. 6A and 6B extending well past the plate 50. Also in the embodiment of FIGS. 6A and 6B, blocking knobs 70, 72 are provided at the ends of two of the fins. The blocking knobs 70, 72 are configured to selectively cover the ports 84, 86 in the switch plate 42, depending upon the position of the switch wheel 40. Accordingly, as shown in FIG. 6B, pads 66, 68 are formed as protrusions on the reverse side 64 of the switch wheel 40. The pads 66, 68 selectively cover ports 84, 86 in the switch plate 42 to help shut off the first flow or second flow of water through the switch plate 42. Similar to the embodiment of FIGS. 5A and 5B, the embodiment of FIGS. 6A and 6B also includes a stop member 56 provided as an extended fin on the switch wheel 40.

As shown in FIGS. 2-4, the switch wheel 40 is rotatably mounted to the switch plate 42 with a shaft 76 that extends from the switch plate 42 and through a hub 69 of the switch wheel 40. The switch plate 42 divides the interior chamber 38 of the water motor into a front portion 38*a* where the switch wheel 40 is mounted and a back portion 38*b* where the water wheel 44 is mounted. This partition 42 allows the switch wheel 40 to be selectively positioned such that either a first flow or a second flow of water passes from the front portion 38*a* to the back portion 38*b* of the interior chamber 38.

Figure 7:
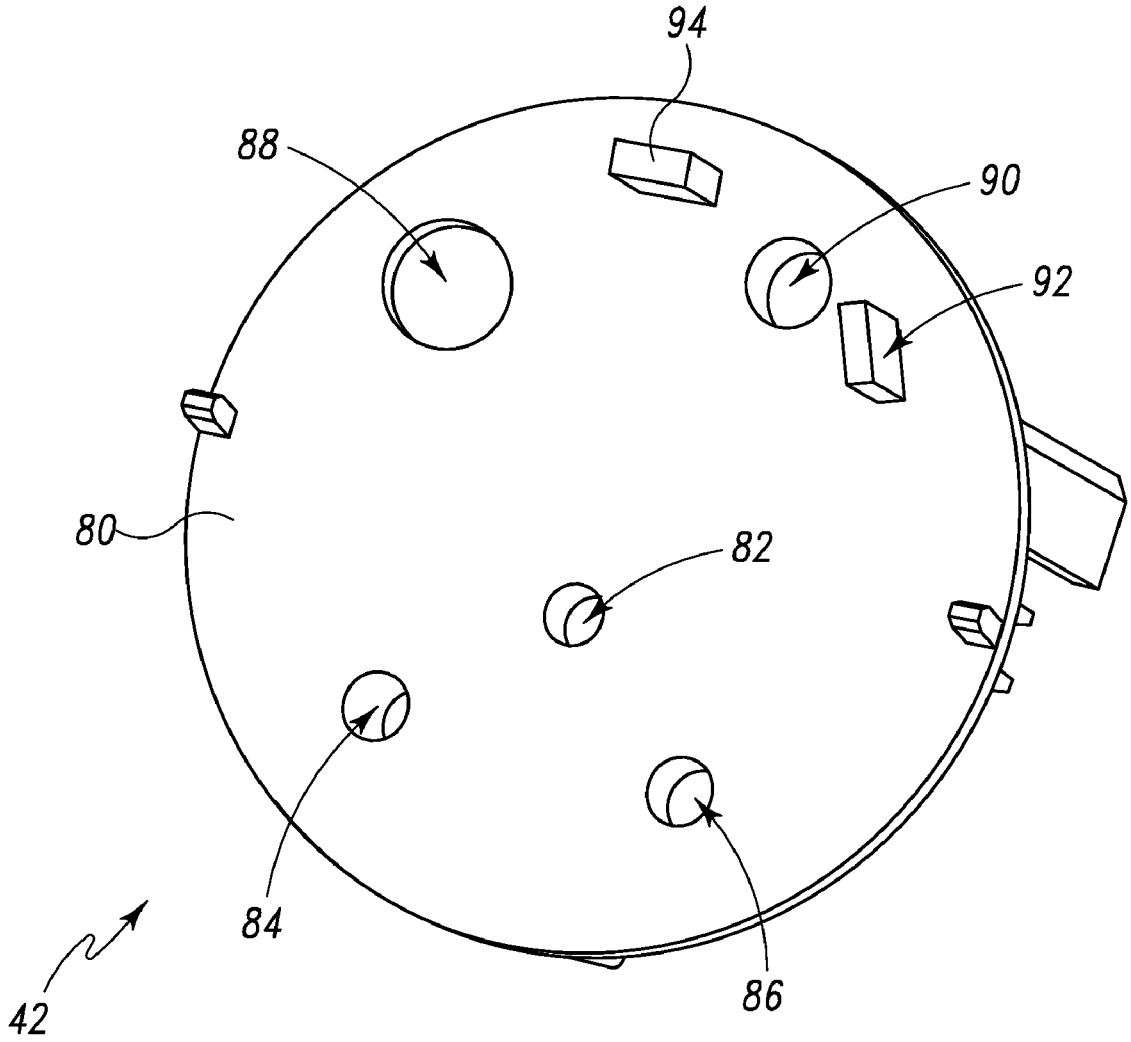
FIG. 7 shows a perspective view of the switch plate of the water motor of FIG. 2.

With reference now to FIG. 7, a forward face 80 of the switch plate 42 is shown. The switch plate 42 includes a mounting hole 82 configured to receive the shaft 76 which mounts the switch wheel to the switch plate. The switch plate also includes a first water port 84 and a second water port 86. The first water port 84 allows the first flow of water to pass through the switch plate 42 at a first location. The second water port 86 allows the second flow of water to pass through the switch plate 42 at a second location that is different from the first location.

With continued reference to FIG. 7, the switch plate 42 also includes a dump valve hole 88 which forms a part of a dump valve. The dump valve includes a plug member 78 (see FIG. 9A) which covers the dump valve hole 88 on the opposite side of the switch plate 42 from the forward face 80. The plug member 78 is spring biased toward the switch plate 42, forcing the plug member 78 against the opposite side of the switch plate from the forward face 80. When water pressure in the front chamber of the water motor 30 exceeds a threshold pressure, the plug member is forced away from the switch plate 42 and water is allowed to flow through the dump valve hole 88 and into the rear chamber of the water motor.

Figure 8:
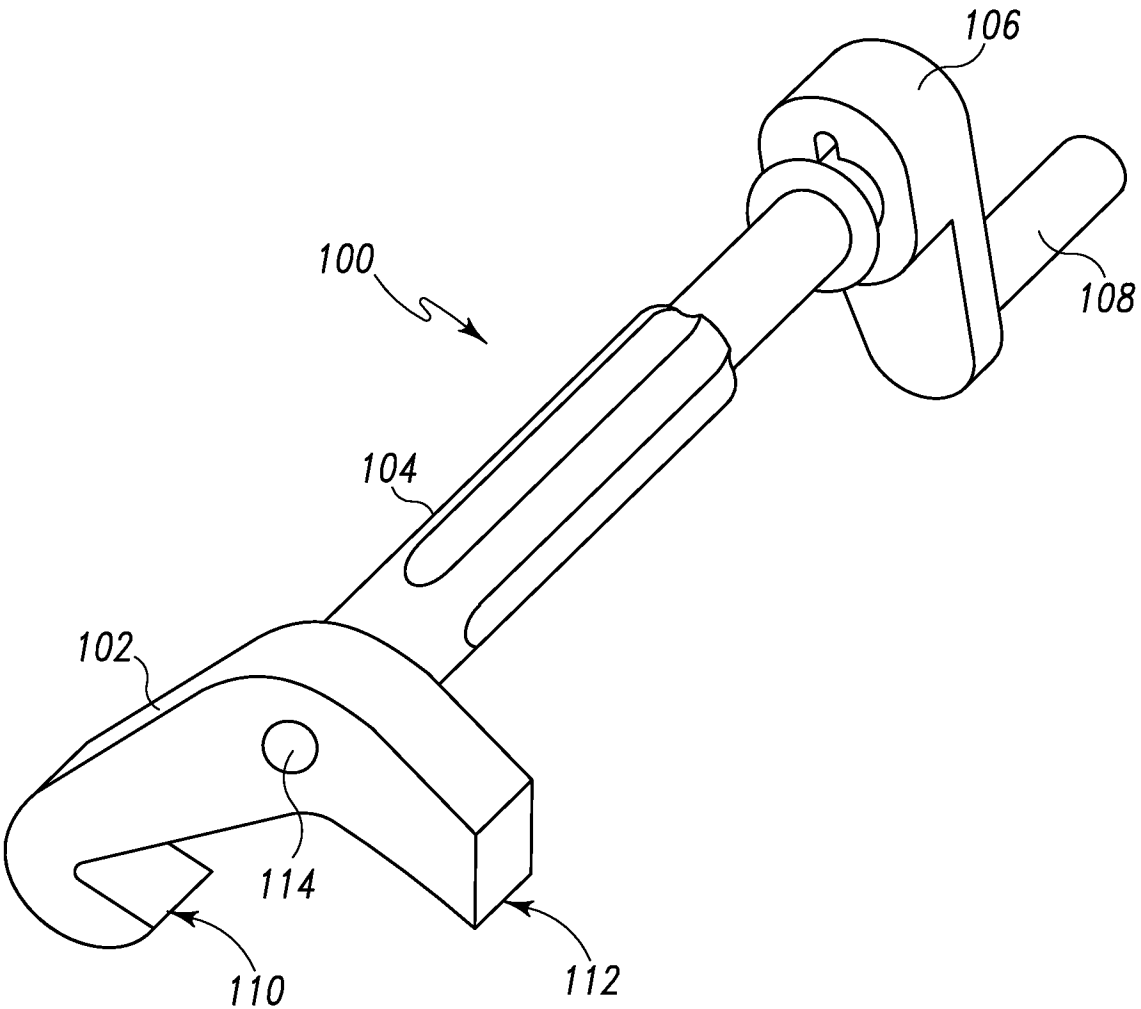
FIG. 8 shows a perspective view of the trip lever of the water motor of FIG. 2.

The switch plate 42 also includes a trip lever hole 90 and two trip lever stops 92, 94. FIG. 8 shows the trip lever 100 that extends through the trip lever hole 90. The trip lever 100 includes a catch 102, an extension arm 104, an elbow 106, and a trip arm 108. The catch 102 is somewhat crescent shaped and includes a hook portion 110 at one end and a stub portion 112 at an opposite end. A pivot point 114 is provided between the hook portion 110 and the stub portion 112 where the extension arm is connected to the catch. As shown in FIG. 2, the catch is situated in the forward portion 38*a* of the interior chamber 38 adjacent to the forward face 80 of the switch plate 42. The catch member is configured to pivot about the pivot point 114 between the trip lever stops 92, 94 on the switch plate 42.

The extension arm 104 of the trip lever 100 extends through the hole 90 on the switch plate 42. As best shown in FIG. 4, the extension arm 104 also extends back through the rear portion 38*b* of the interior chamber 38, and out of another hole in the motor housing 32. The elbow 106 is connected to the extension arm 104 outside of the motor housing 32. The trip arm 108 extends outward from the elbow. Because the components of the trip lever 100 are rigidly connected, a pivot of the trip arm 108 outside of the motor housing 32 results in a related pivot of the catch 102 within the motor housing 32.

With reference again to FIG. 3, the water wheel 44 is rotatably mounted in the rear portion 38*b* of the interior chamber 38 of the housing. Similar to the switch wheel 40, the water wheel 44 is provided as a turbine member that includes a plurality of fins 120 extending in a radial fashion from a central hub 122. The water wheel 44 rotates about a stationary shaft 124. Placement of the water wheel 44 between the first port 84 and the second port 86 of the switch plate 42 allows the water wheel 44 to be driven in two opposing directions. Water flow through the first port 84 strikes the fins 120 on the lower portion of the water wheel 44, causing the water wheel to rotate in a counter-clockwise direction. Water flow through the second port 86 strikes the fins 120 on the upper portion of the water wheel 44, causing the water wheel to rotate in a clockwise direction.

As best seen in FIG. 3, the water wheel 44 is connected to a drive train 46. Accordingly, gear teeth may be provided on the opposite side of the water wheel 44 from the fins 120. The gear teeth are operably engaged with a series of additional gears in the drive train. Rotation of the water wheel 44 imparts rotation to the gears of the tear train 46 and results in rotation of the output gear 48.

The output gear 48 includes a first end including a plurality of gear teeth 126 and an opposite end including a plurality of fingers 130. The first end of the output gear is positioned within the motor housing 32 and the second end of the output gear extends outside of the motor housing 32. The motor housing includes a hole for the output gear 48 that serves as a bearing and allows the output gear 48 to rotate in a forward direction and a reverse direction. For example, when the water wheel 44 spins in the clockwise direction, the water wheel and drive train 46 cause the output gear 48 to rotate in a first direction. When the water wheel 44 spins in a counter-clockwise direction, the water wheel 44 and drive train 46 cause the output gear 48 to rotate in a second direction which is opposite the first direction.

Overall operation of the water motor 30 will now be explained with reference to FIGS. 3, 9A and 9B. As best seen in FIG. 3, the water motor 20 is powered by a flow of water 118, such as water from a garden hose. The flow of water 118 enters the water motor through the water hose inlet 26. The flow of water 118 moves through the channel 35 and onto the switch wheel 40. The channel 35 directs the water onto the switch wheel 40 such that the switch wheel is driven in a counter-clockwise direction by the flow of water 118.

When the switch wheel 40 is driven in a counter-clockwise direction, the stop 56 on the switch wheel 40 quickly contacts the trip lever catch 102 and blocks further rotation of the switch wheel 40. The catch 102 is configured to hold the switch wheel in one of the two distinct positions shown in FIGS. 9A and 9B.

Figure 9A:
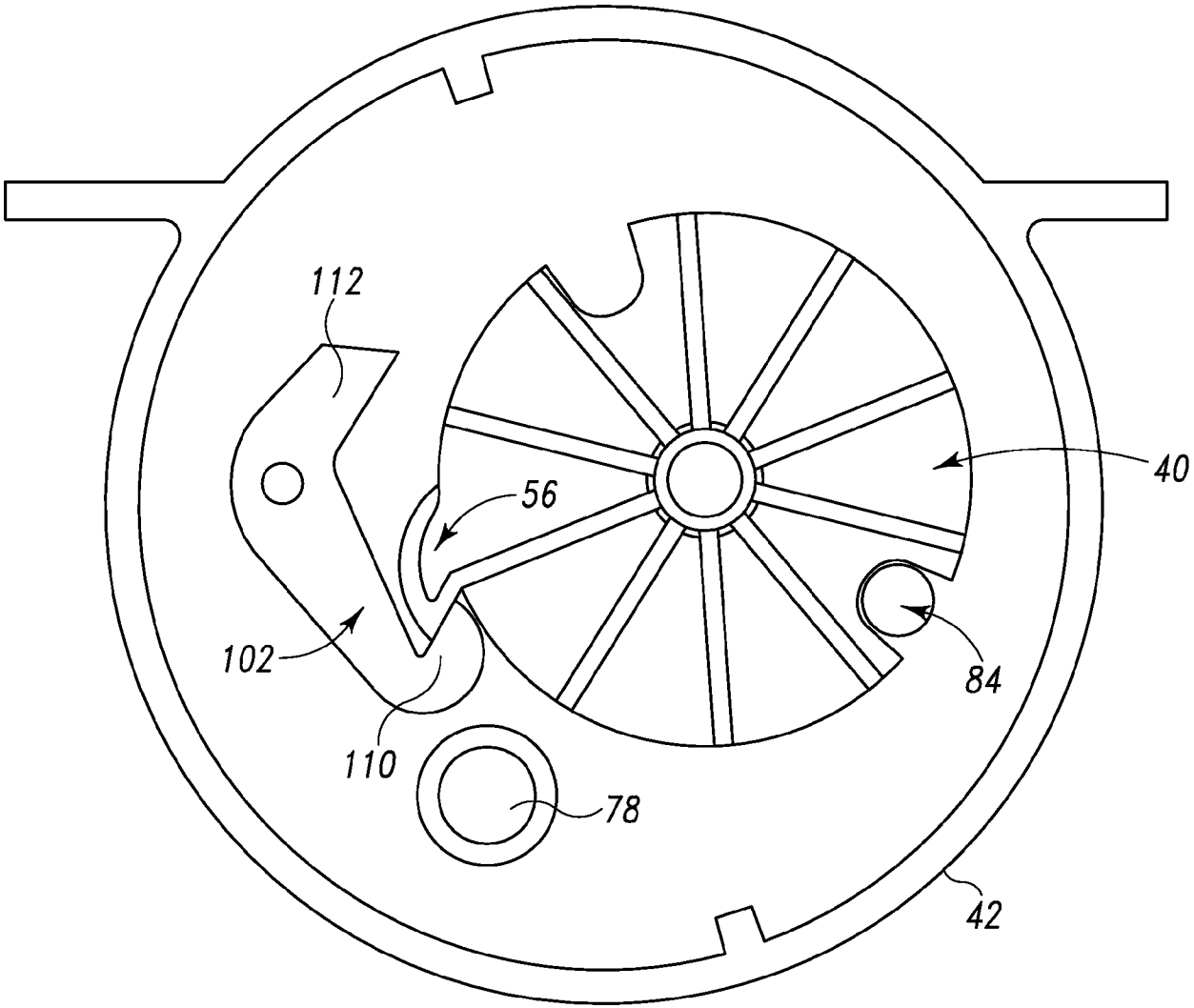
FIG. 9A shows a first stop position of the switch wheel of the water motor of FIG. 2.
Figure 9B:
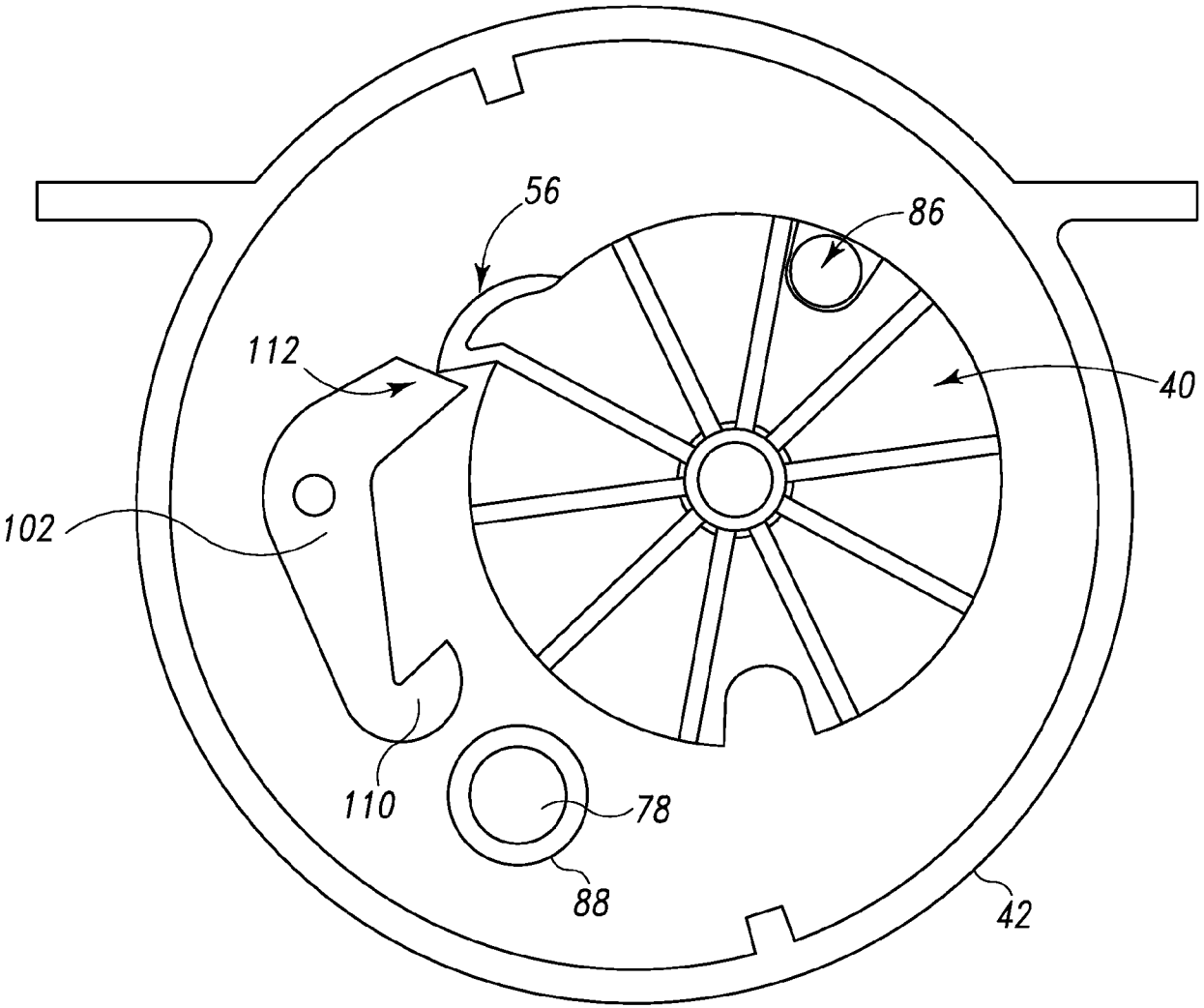
FIG. 9B shows a second stop position of the switch wheel of the water motor of FIG. 2.

FIGS. 3 and 9A both show the switch wheel 40 stopped in a first position with the hook portion 110 of the catch 102 engaging the stop 56 of the switch wheel 40. With the switch wheel 40 in this position, the first port 84 on the switch plate is open and the second port 86 on the switch plate is closed. This allows a first flow of water (indicated by arrow 116 in FIG. 3) to pass through the first port 84 of the switch plate. At the same time, the switch plate 42 blocks water from flowing through the second port 86. The first flow of water 116 is directed by the first port 84 onto the lower portion of the water wheel 44, driving the water wheel 44 in a counter-clockwise direction. Movement of the water wheel 44 in this counter-clockwise direction causes the drive train 46 to rotate the output gear 48 in one direction (e.g. a first output direction). Rotation of the output gear 48 in this first output direction drives the spray tube 22 to the left until it reaches a user determined oscillation point (e.g., a leftmost position) where the trip arm 108 is automatically pivoted.

When the trip arm 108 is pivoted, the catch 102 of the trip arm is rotated away from the stop 56 of the switch wheel 40, allowing the switch wheel 40 to once again rotate in the counter-clockwise direction as it is driven by the incoming flow of water 118. The catch 102 is rotated to the position shown in FIG. 9B by the automatic rotation of the trip arm 108. With the catch 102 in this position, the stop 56 of the switch wheel 40 contacts the stub portion 112 of the catch 102, and the switch wheel 40 is blocked from rotation and is stopped in a second position. With the switch wheel 40 in this second position, the second port 86 of the switch plate 42 is open to water flow while water flow through the first port 84 is blocked. When water flows through the port 86, the direction of the water wheel 44 is reversed because the water flow acts on the fins positioned on the opposite side (i.e., upper side) of the water wheel 44, causing the water wheel to rotate in a clockwise direction. Rotation of the water wheel 44 in this direction drives the gear train 46 and the output gear 48 in the opposite direction (i.e., a second output direction). When the output gear 48 is driven in this opposite direction (i.e., to the right), the spray tube 22 is also driven in the opposite direction. When the spray tube reaches a user defined oscillation point (e.g., a rightmost position) the trip arm is automatically pivoted in the opposite direction, causing the catch 102 to rotate back to the position shown in FIG. 9A, and the cycle repeats itself.

As described above, when the switch wheel catch 102 is released, the switch wheel 40 will always rotate counter-clockwise to the next stop position since the incoming flow of water is always driving the switch wheel to rotate counter-clockwise. With this arrangement, the switch wheel 40 is continuously being powered or "loaded" by the incoming water from the hose inlet 26. Thus, the switch wheel 40 is independently powered, distinct from the drive train 46 of the water motor. The switch wheel catch 102 is released via power from the motor, but this release requires very little motor power. The catch 102 is designed so that it has very low load and no motor power is lost until the catch has completely released. After release, the motor power by water flow acting on the water wheel 44 is very quickly restored in the opposite direction. This quick switching action of the rotating switch wheel 40 helps reduce and substantially eliminate the lag time between spray tube motion while the switch is occurring.

It will be recognized that the foregoing embodiment of the water motor requires a relatively small number of parts and a relatively simple design. The design does not require numerous critical dimensions or tolerances. Thus, the water motor 30 is relatively easy to manufacture and has a relatively long life. The water motor also works well with a variety of water pressures and flow conditions. Furthermore, although a particular embodiment of the water motor has been described, it will be appreciated that numerous other embodiments are possible, including the embodiment, for example, where the switch wheel of FIGS. 6A and 6B is used in place of the switch wheel of FIGS. 5A and 5B.

Sprinkler Tube Motor Adaptor and Clutch Mechanism

Figure 10:
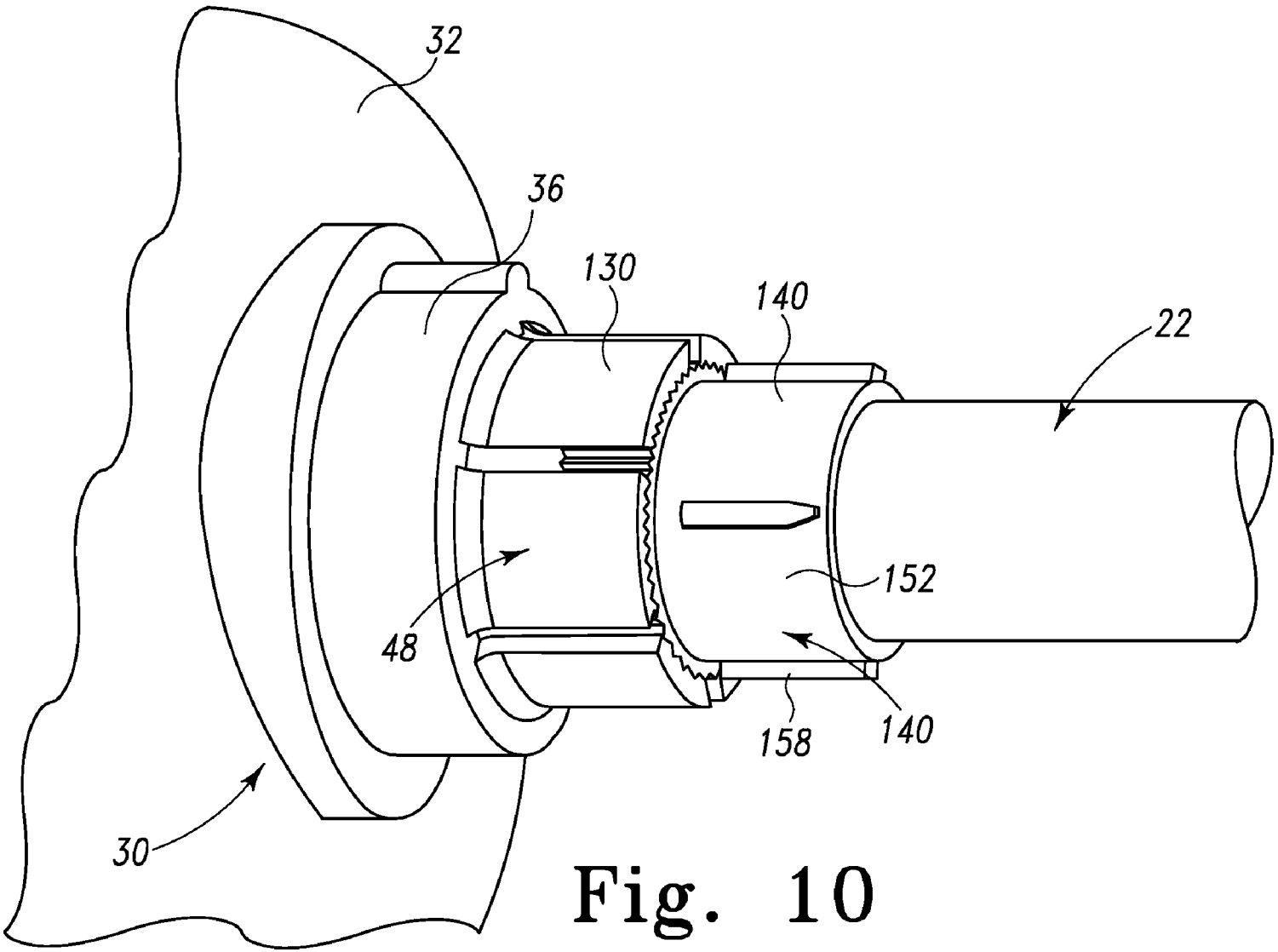
FIG. 10 shows a perspective view of a sprinkler tube adaptor and clutch mechanism for the water motor of FIG. 2.

With reference to FIG. 10, a tube adaptor 140 is provided between the output gear 48 and the spray tube 22. The tube adaptor 140 is used to easily attach the spray tube 22 to the output gear 48 by allowing the spray tube 22 to be pressed into the adaptor 140, and allowing the adaptor 140 to be pressed into the output gear 48. The adaptor 140 also acts as a clutch to provide a torque limiting function between the spray tube 22 and the output gear 48. Both the output gear 48 and the tube adaptor 140 are configured with interior passages that allow water to be passed through the output gear a tube adaptor as a water flow moves from the water motor 30 to the spray tube 22.

Figure 11:
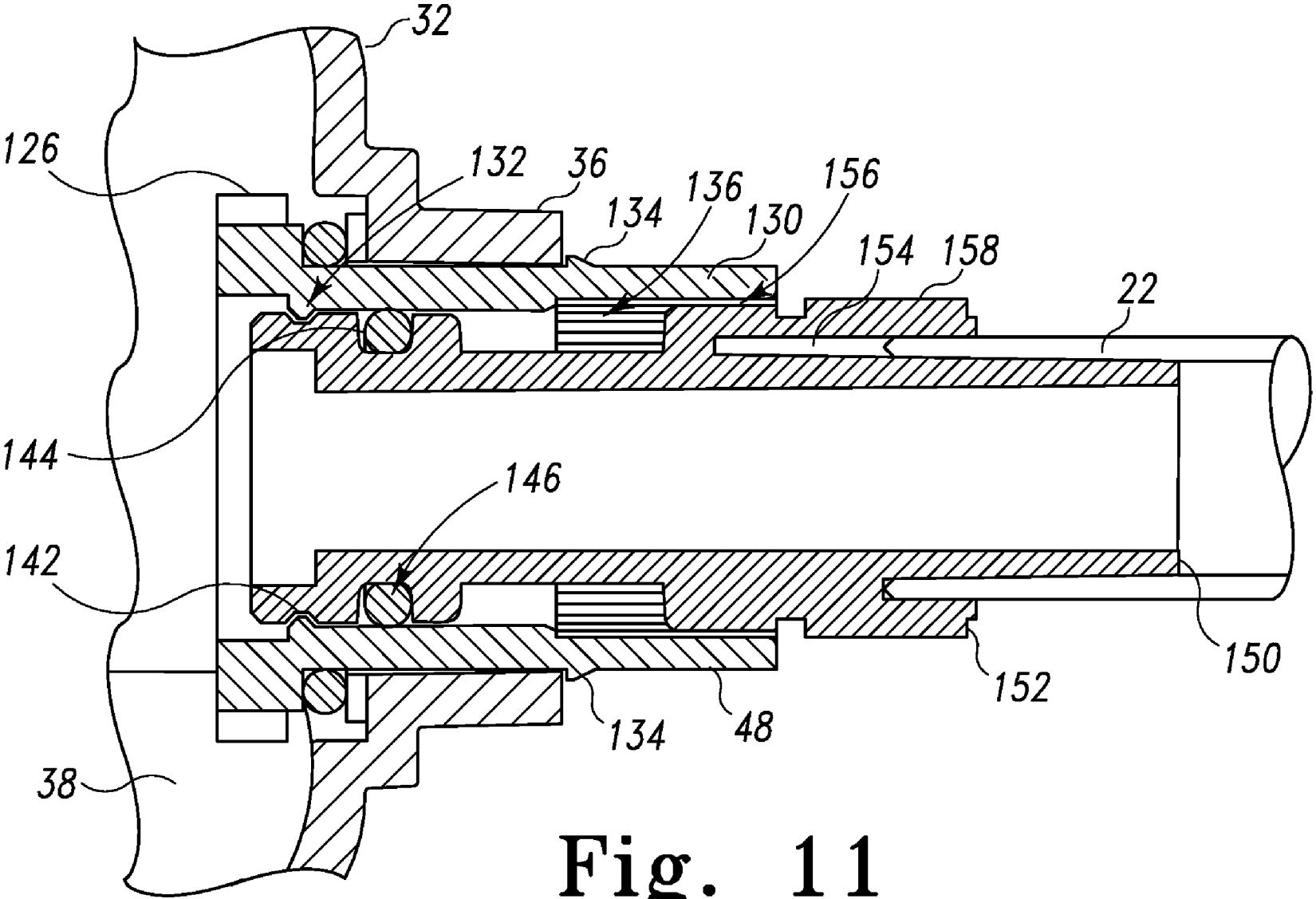
FIG. 11 shows a cross-sectional view of the sprinkler tube adapter and clutch mechanism of FIG. 10.
Figure 12:
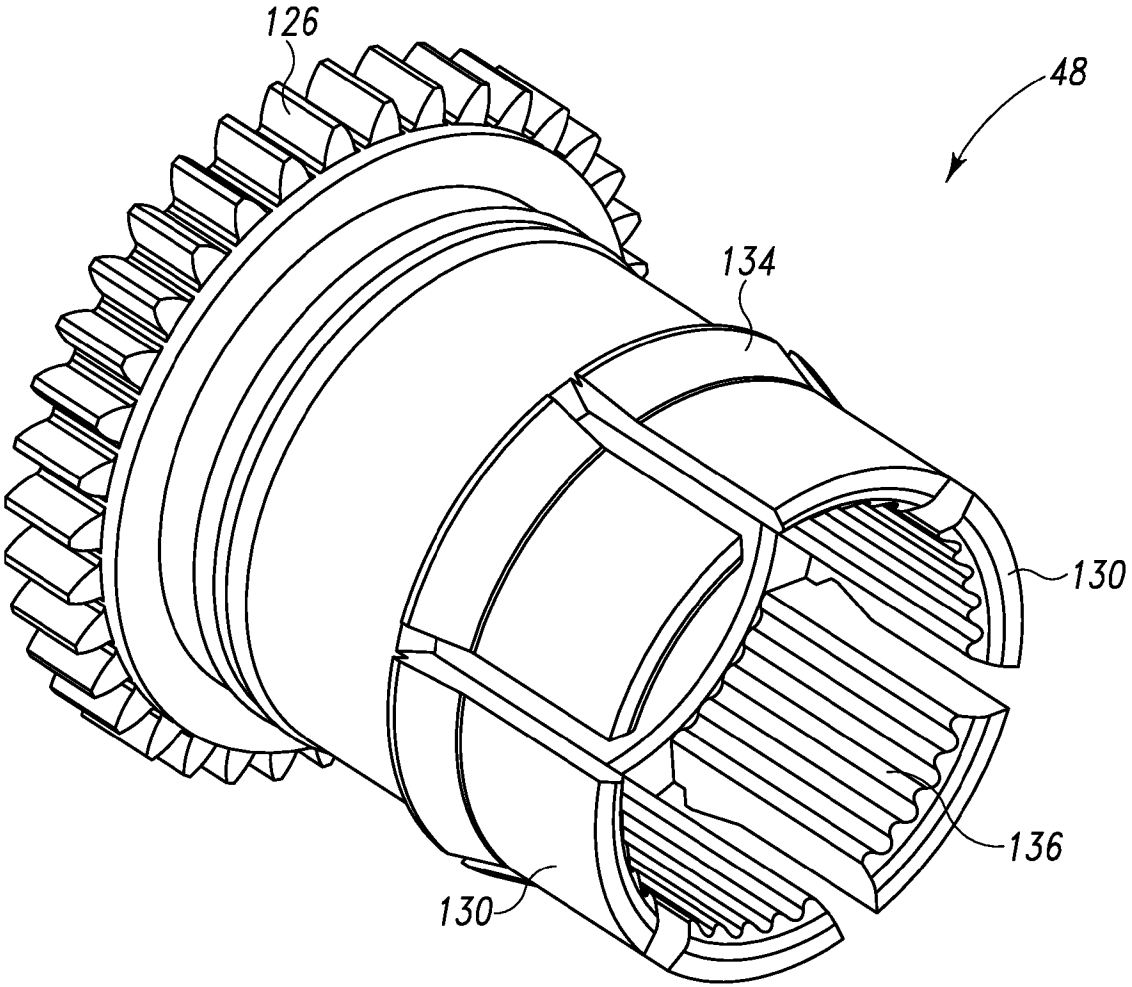
FIG. 12 shows a perspective view of the output gear of the water motor of FIG. 2.

With reference now to FIGS. 11 and 12, the output gear 48 is rotatably mounted on the motor housing 32 with the water outlet 36 providing a bearing for the output gear 48. The output gear 48 is substantially cylindrical in shape and the cylindrical walls of the output gear 48 define an interior water passage. A first end of the output gear 48 is positioned within the housing 32 and a second end of the output gear 48 is positioned outside of the housing 32.

The first end of the output gear 48 includes a plurality of teeth 126 which extend radially outward from the outer surface of the output gear 48. These teeth 126 are configured to engage the gear train 46 of the water motor. The first end of the output gear 48 also includes a circumferential rib 132 that extends around the inner surface of the output gear.

The second end of the output gear 48 includes a plurality of fingers 130 which extend in an axial direction from the cylindrical output gear 48. The base of each finger 130 is defined by a tab 134 which abuts the outer surface of the housing 32 of the water motor 30, thus preventing the output gear 48 from sliding axially inward toward the interior chamber 38 of the water motor. A plurality of clutch teeth 136 are provided on the interior surface of each finger 130.

Figure 13:
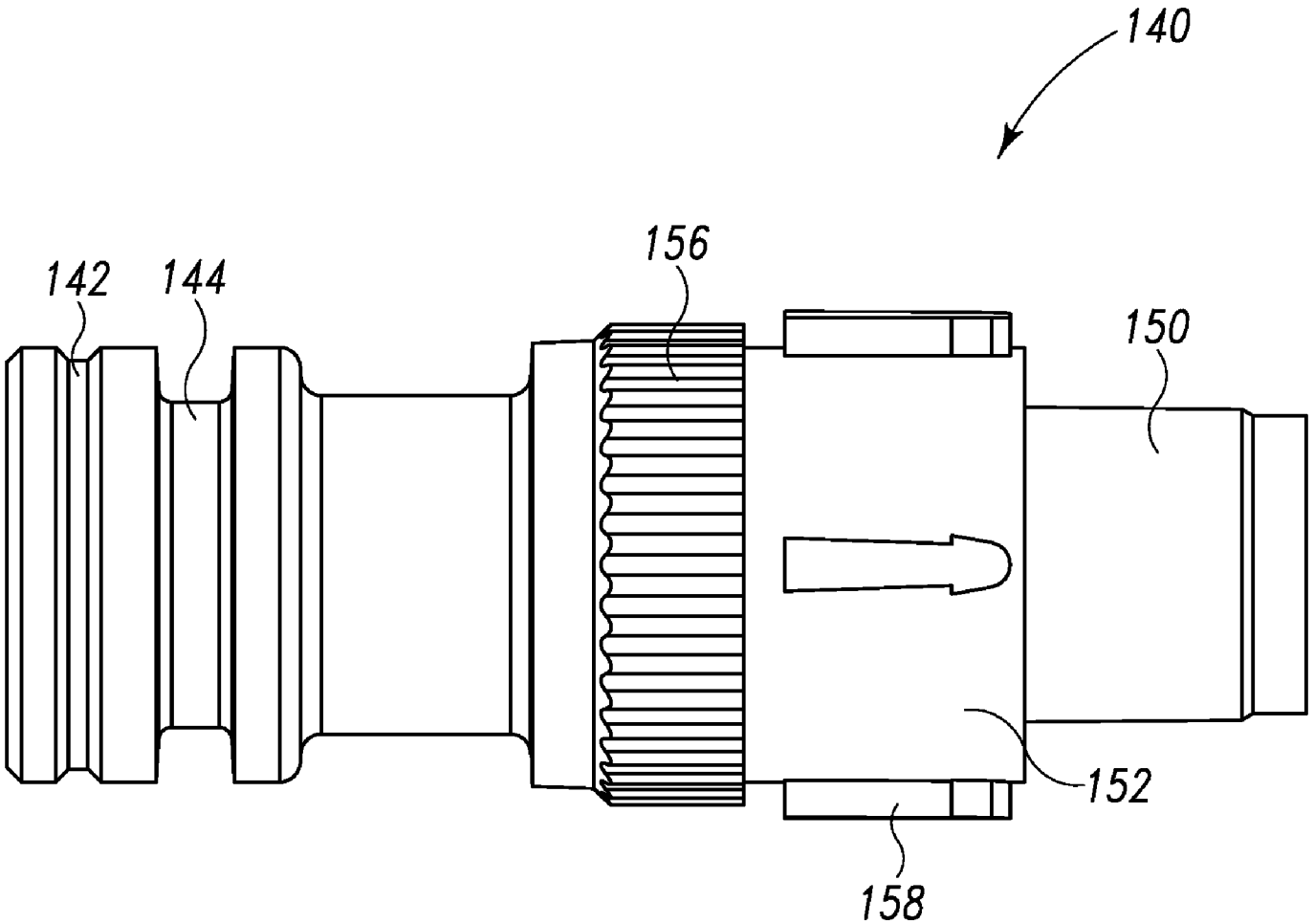
FIG. 13 shows a side view of the sprinkler tube adaptor of FIG. 10.

With reference now to FIGS. 11 and 13, the tube adaptor 140 is configured to fit within the output gear 48. Similar to the output gear 48, the tube adaptor 140 is also substantially cylindrical in shape. The tube adaptor 140 is positioned coaxial with the output gear 48. A first end of the tube adaptor 140 fits within the output gear 48, and a second end of the tube adaptor 140 extends axially outward from the output gear 48.

The first end of the tube adaptor 140 includes a first circumferential groove 142 and a second circumferential groove 144. The first circumferential groove 142 is configured to receive the circumferential rib 132 on the output gear. In particular, when the tube adaptor 140 is slid into the output gear 48 with a sufficient force in the axial direction, the circumferential rib 132 on the output gear 48 snaps into the first circumferential groove 142 on the tube adaptor 140. This engagement secures the tube adaptor 140 to the output gear 48 in the axial direction. The second circumferential groove 144 is configured to receive an O-ring 146. The O-ring 146 provides a watertight seal between the output gear 48 and the tube adaptor 140.

The second end of the tube adaptor 140 includes an interior cylindrical portion 150 and an exterior cylindrical portion 152, with a cylindrical cavity 154 defined therebetween. The cylindrical cavity is dimensioned to receive the spray tube 22. Friction between the spray tube 22 and the interior and exterior cylindrical portions 150, 152 secures the spray tube 22 to the tube adaptor 140 such that oscillation of the tube adaptor 140 and output gear 48 also result in oscillation of the spray tube.

A plurality of clutch teeth 156 are also provided on the outer surface of the exterior cylindrical portion 152 of the tube adaptor 140. These clutch teeth 156 are configured to engage the clutch teeth 136 on the inner surface of the output gear 48. In particular, when the tube adaptor 140 is slid into the output gear 48, the clutch teeth 156 of the tube adaptor 140 mesh with the clutch teeth 136 of the output gear. The engagement of the clutch teeth 136 on the output gear with the clutch teeth 156 on the tube adaptor 140 allows the output gear 48 to impart a torque to the tube adaptor 140. However, the flexible fingers 130 on the output gear 48 also act as a torque limiter in the form of a slip clutch. In particular, when a threshold torque is encountered between the output gear 48 and the adaptor member 140, the fingers 130 flex to a sufficient degree to allow the clutch teeth 136 of the output gear 48 to slide over the clutch teeth 156 of the tube adaptor in a ratcheting fashion. This provides a torque limiting relationship between the tube adaptor 140 and the output gear.

In addition to the foregoing, the tube adapter 140 also includes a plurality of axial ribs 158 located on the exterior cylindrical portion 152. These ribs 158 act as a locator that orients an adjusting mechanism in a correct position when the sprinkler is assembled, as will be explained in further detail below.

Spray Coverage Adjusting Mechanism

Figure 14:
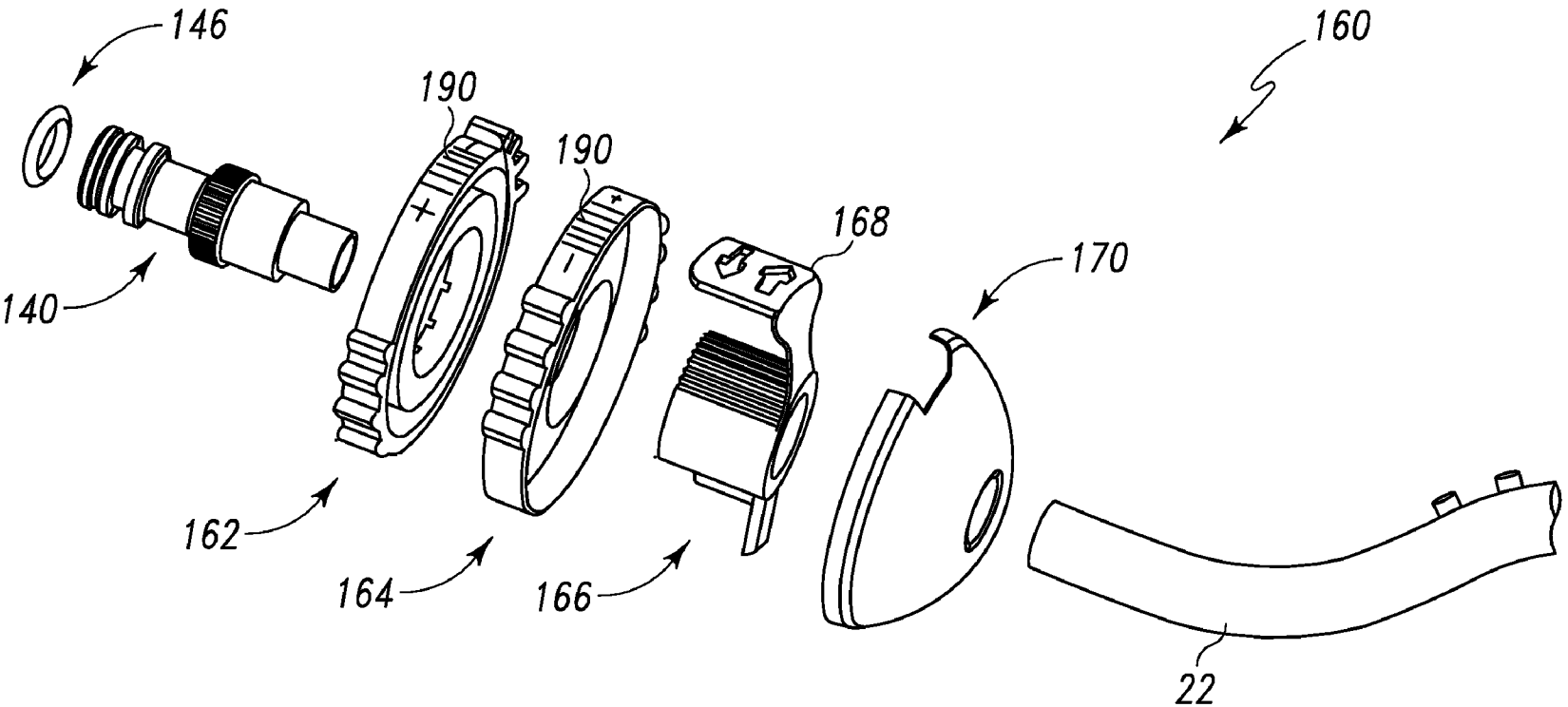
FIG. 14 shows an exploded perspective view of a spray coverage adjusting mechanism for the sprinkler of FIG. 1.

With reference now to FIGS. 1 and 14, a spray coverage adjusting mechanism 160 is provided on the sprinkler 20 between the spray tube 22 and the water motor 30. The spray coverage adjusting mechanism 160 is positioned on the tube adaptor 140 and comprises a left spray adjustment member 162 and a right spray adjustment member 164. The left and right spray adjustment members 162, 164 are positioned on a spray coverage indicator 168 which readily indicates the degree of coverage selected based on the position of the left and right spray adjustment members 162, 164. The spray coverage adjusting mechanism 160 also includes an end cap 169 which covers the face of the spray adjustment member 164.

Figure 15:
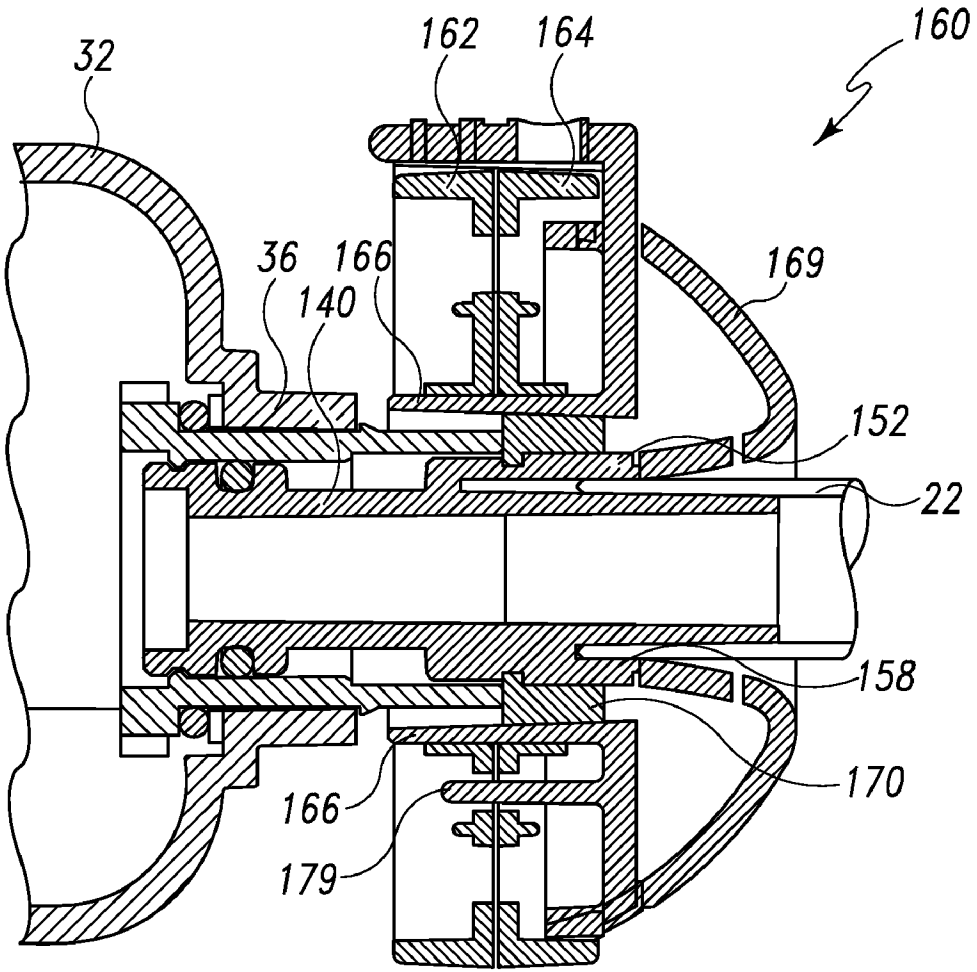
FIG. 15 shows a cross-sectional view of the spray coverage adjustment mechanism of FIG. 14.
Figure 17:
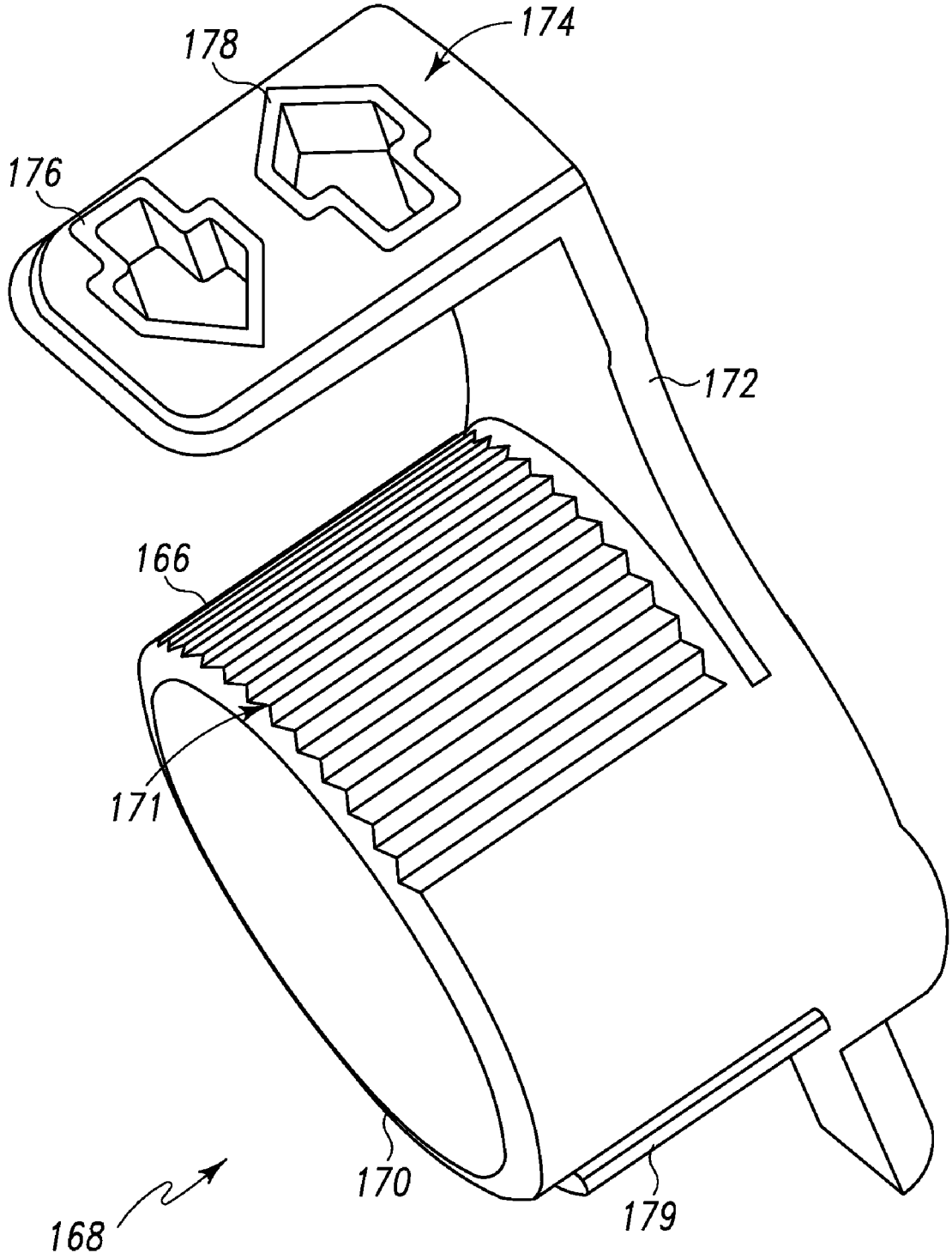
FIG. 17 shows a perspective view of a spray coverage indicator for the spray coverage adjustment mechanism of FIG. 14.

With reference now to FIGS. 15 and 17, the spray coverage indicator 168 component comprises a collar 166, a post 172, and an indicator frame 174. The collar 166 is substantially cylindrical in shape and is configured to slide over the exterior cylindrical portion 152 on the end of the tube adaptor 140. The collar 166 includes a plurality of interior ribs 170 (see FIG. 15) configured to engage the ribs 158 on the tube adaptor 140. The engagement of the ribs 158 and 170 properly orients the collar 166 on the tube adaptor 140 and also secures the collar 166 to the tube adaptor 140 such that rotation of the tube adaptor 140 also results in rotation of the collar 166. The collar 166 further comprises a plurality of ratchet teeth 171 which extend in an axial direction along the outer surface of the collar 166. The ratchet teeth 171 are configured to engage complementary ratchet teeth on the left and right spray coverage adjustment members 162, 164.

As best seen in FIG. 17, the post 172 is attached to the collar 166 and extends upward and outward from the collar 166 in a radial direction. The indicator frame 174 is provided as a selection tab 174 attached to the end of the post 166. The selection tab 174 includes two arrow shaped openings 176, 178 which form windows in the tab 174. As explained in further detail below, the first window 176 is used to show an operator the selected spray coverage to the left of the sprinkler 20 and the second window 178 is used to show an operator the selected spray coverage to the right of the sprinkler 20. The term "window" as used herein comprises any partially or completely bounded opening that allows a user to see indicia provided on another component, regardless of whether the opening defines a complete void in a given component or if a transparent or other see-through material is provided in or is adjacent to the opening.

A finger 179 is connected to the collar 166 on the opposite side of the collar 166 from the post 172. As explained in further detail below, the finger 179 acts as a governor to limit the degree to which the left and right spray adjustment members 162, 164 may be rotated on the collar 166.

Figure 16:
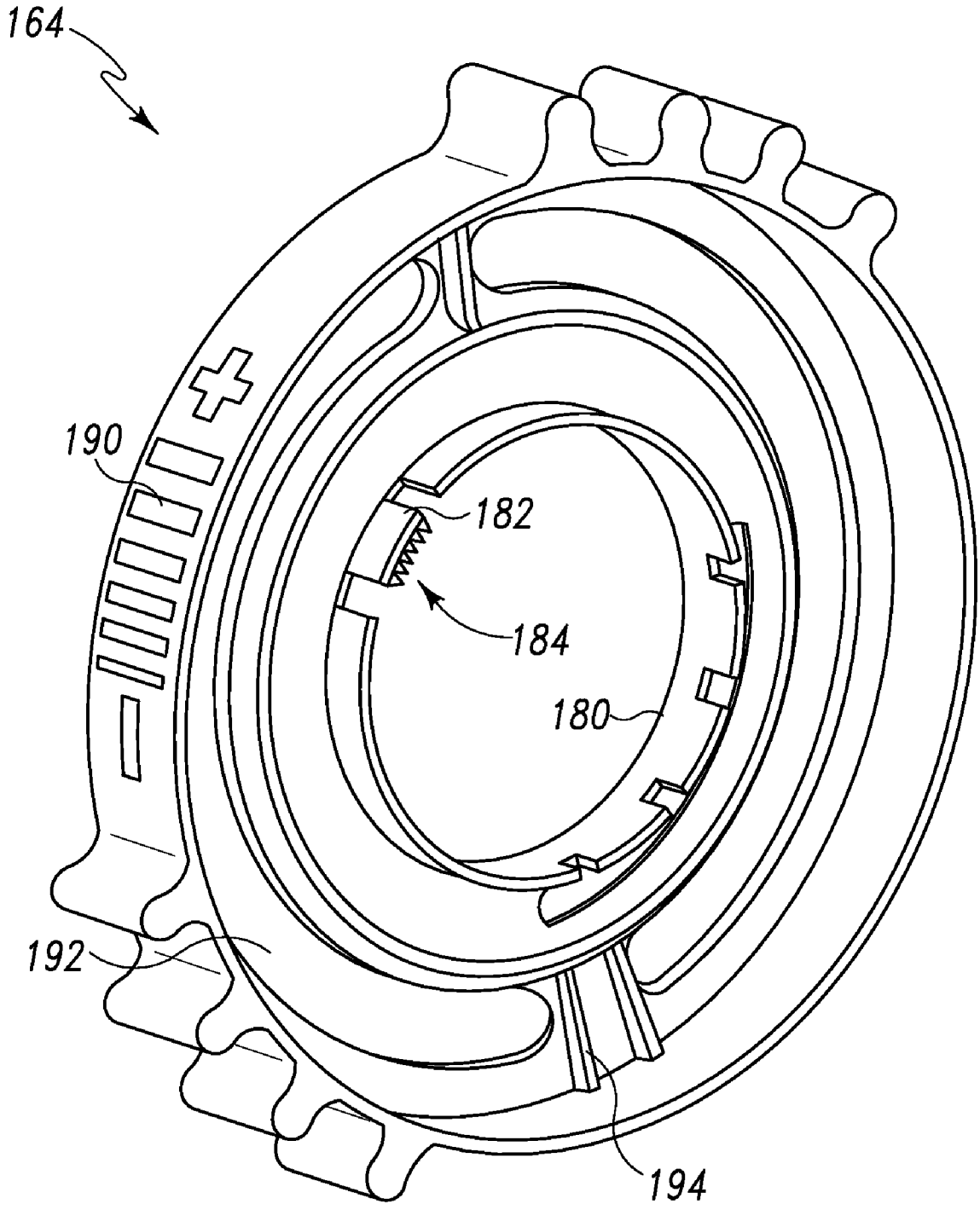
FIG. 16 shows a perspective view of a right side spray adjustment member for the spray coverage adjustment mechanism of FIG. 14.

With reference now to FIGS. 15 and 16, the left and right spray adjustment members 162, 164 are provided as circular dials positioned on the collar 166. As exemplified by the right adjustment dial 164 of FIG. 16, each dial includes an interior hub 180 which fits over the collar 166. A tab 182 is provided on the hub 180 with a plurality of ratchet teeth 184 extending in an axial direction along the tab. The ratchet teeth 184 of the dial 164 engage the teeth 171 of the collar 166, providing a slip clutch arrangement between the dial 164 and the collar 166. In particular, the engagement of the teeth 171 and 184 secure the dial 164 to the collar 166 until a threshold torque is applied to the dial 164.

The dial 164 also includes a multi-faceted grip 188 provided on an outer circumference 186 of the dial. The multi-faceted grip 188 is configured to allow a user to easily grasp the dial with his or her fingers and rotate the dial to the left or the right while the collar 166 remains secured to the adaptor member 140. When the user provides a sufficient torque to rotate the dial 164 to the left or the right, the tab 182 on the hub 180 of the dial 164 flexes a sufficient amount to allow the ratchet teeth 184 on the dial 164 to slide over the teeth 171 on the collar member.

Figure 19:
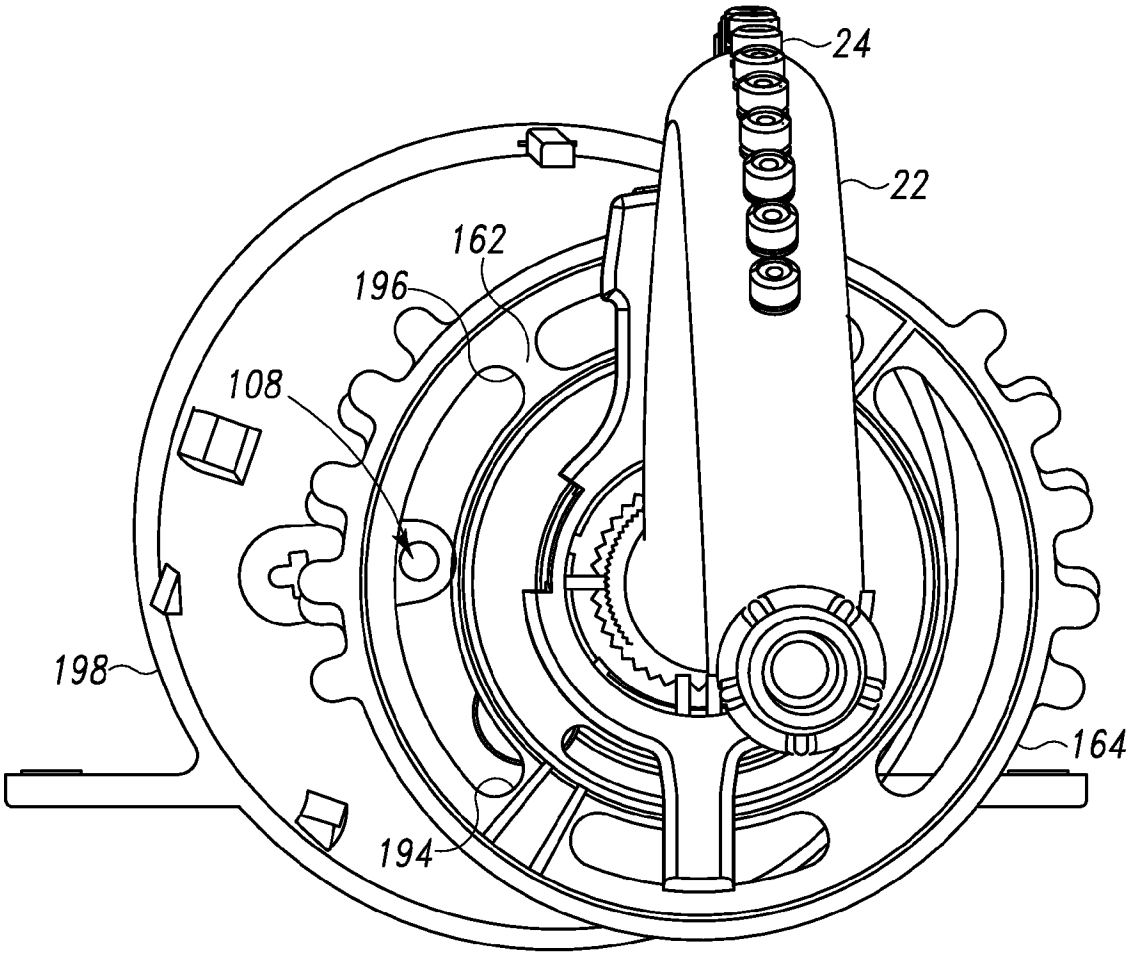
FIG. 19 shows an axial end view of the spray coverage adjustment mechanism of FIG. 18 with the end cap removed to expose the spray adjustment members.

With reference now to FIGS. 16 and 19, each dial 162, 164 includes a semi-circular slot 192 or other opening configured to receive the trip arm 108 of the trip lever 100. When the dials 162, 164 are situated on the collar 166 adjacent to one another, the slots 192 together define a race 198 for the trip arm 108. The end 194 of the slot 192 on dial 164 defines a first end of the race 198. An opposing end 196 of a slot on dial 162 defines a second end of the race 198. As the dials 162, 164 oscillate with the spray tube 22, the race 198 is moved relative to the trip arm. When the first end 194 of the race 198 moves into contact with the trip arm 108, the trip lever 100 and associated catch 102 are pivoted, and the direction of the drive train 46 of the water motor 30 is reversed, as discussed above. Similarly, when the second end 196 of the race 198 comes into contact with the trip arm 108, the trip lever 100 and associated catch 102 are pivoted in an opposite direction, causing the direction of the drive train of the water motor 30 to once again reverse. Rotation of the dials 162, 164 elongates or shortens the race 198 provided by the slots in the dials by moving the first end 194 and/or second end 196 of the race relative to the trip arm 108. In this manner the degree of spray coverage on the left and right sides of the sprinkler can be increased or decreased by rotating the dials 162, 164. Furthermore, the degree of rotation of the dials 162, 164 relative to the collar 166 is limited by the finger 179 that is connected to the collar and extends through the slots 192.

Figure 18:
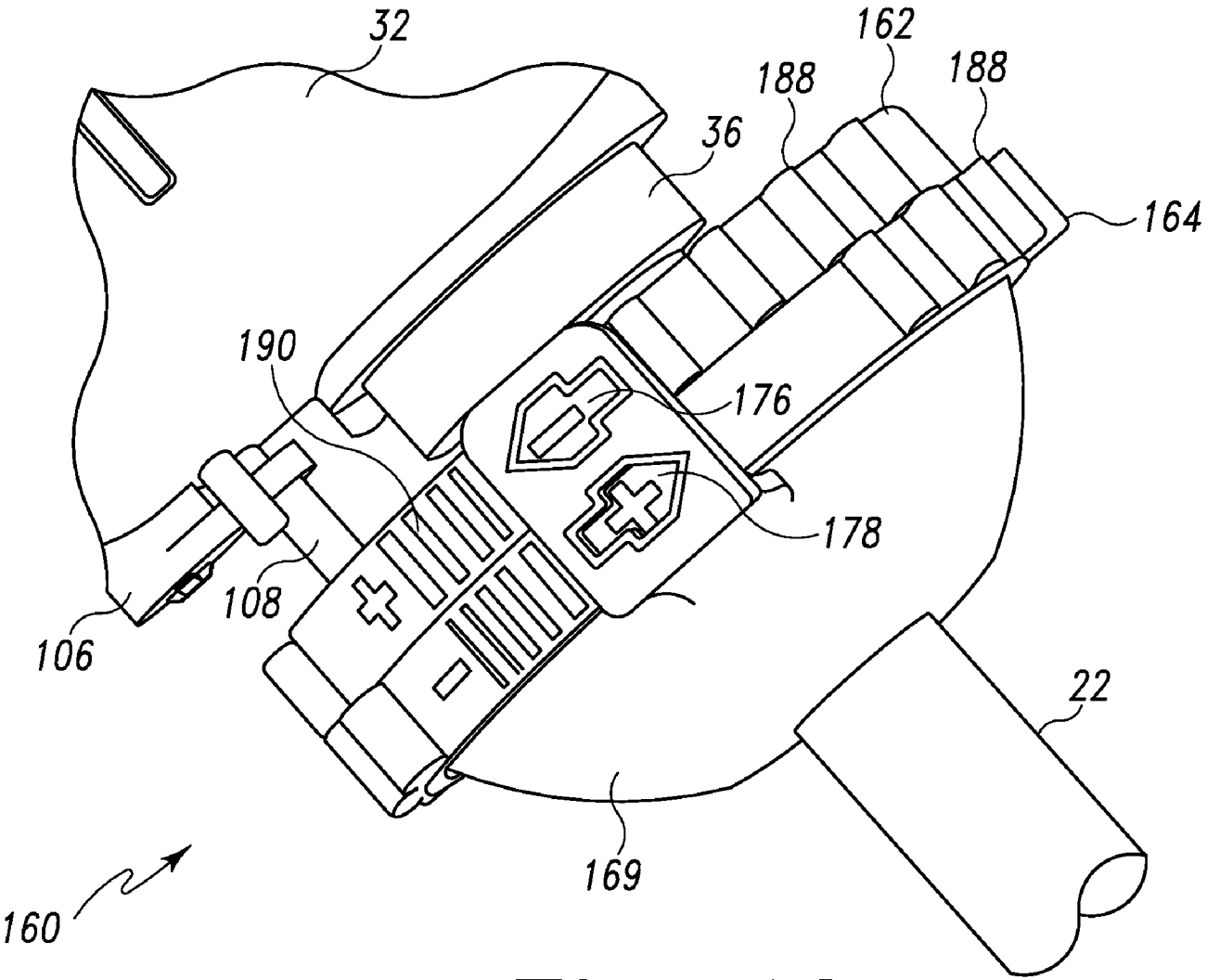
FIG. 18 shows a top view of the assembled spray coverage adjustment mechanism of FIG. 14.

As best seen in FIGS. 16 and 18, each dial 162, 164 include indicia 190 provided on the outer circumference of the dial. The indicia 190 indicate various degrees of spray coverage available with the dial. In the embodiment of FIGS. 16 and 18, the indicia include a series of marks provided in-between a + sign and a – sign. The + sign is intended to represent a maximum degree of coverage and the – sign is intended to represent a minimum degree of coverage. A series of markings of decreasing width are provided between the + sign and the – sign. Wider markings indicate greater coverage area, and thinner markings indicate a lesser coverage area.

When used in association with the arrow windows 176, 178, the indicia 190 indicate the degree of spray coverage provided by the sprinkler 20 based on the position of the dials 162, 164. For example, in the embodiment of FIG. 18, the "–" sign centered in arrow window 176 indicates that a minimum degree of spray coverage will be provided on the left side of the sprinkler 20. At the same time, the "+" sign centered in arrow window 178 indicates that a maximum degree of spray coverage will be provided on the right side of the sprinkler 20. Accordingly, by watching the windows 176, 178 while rotating the dials 162, 164, the user is provided with an indication of the amount of spray coverage that has been selected for the right and left sides of the sprinkler.

As set forth above, the embodiment of FIGS. 15-19 provides a sprinkler 20 including arrow windows 176, 178 that point to one side or the other to indicate the coverage selected for that side of the sprinkler. The adjustment mechanism of the sprinkler 20 includes two dials 162, 164 with indicia 190 visible through the arrow windows 176, 178 to indicate a degree of spray coverage for the referenced side of the sprinkler. While exemplary indicia are shown in FIGS. 15-19, it will be recognized that the indicia may take any of numerous other forms, such as, for example, numerical degrees of coverage or an increasingly wider line that indicates an increasingly greater degree of spray coverage. In such embodiments, the focus of the user is directed to the arrow window and the indicia showing through the arrow window when selecting a degree of spray coverage.

Although the present invention has been described with respect to certain preferred embodiments, it will be appreciated by those of skill in the art that other implementations and adaptations are possible. For example, although the embodiments described herein show an oscillating water sprinkler, adaptations of various features for rotor type sprinklers, impulse sprinklers, or other sprinklers are also possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A sprinkler apparatus comprising:

a water wheel configured to be alternatively driven in a first wheel direction by a first fluid flow and a second wheel direction by a second fluid flow;

a water spray member including at least one fluid outlet, the water spray member moveable in a first spray member direction in response to the water wheel being driven in the first wheel direction, the water spray member further moveable in a second spray member direction in response to the water wheel being driven in the second wheel direction;

a switch wheel positioned to receive an initial fluid flow and generate the first fluid flow and the second fluid flow therefrom; and a partition separating the water wheel from the switch wheel, a first passage and a second passage provided in the partition, wherein the first fluid flow passes through the first passage and the second fluid flow passes through the second passage.

2. The sprinkler apparatus of claim 1 wherein the water spray member includes an inlet for receiving the first and second fluid flows and wherein the first and second fluid flows are distributed through the at least one fluid outlet.

3. The sprinkler apparatus of claim 1 wherein the switch wheel comprises a plurality of vanes.

4. The sprinkler apparatus of claim 1 wherein the switch wheel is rotatable from a first position to a second position, wherein the switch wheel blocks fluid from passing through the second passage when the switch wheel is in the first position and wherein the switch wheel blocks fluid from passing through the first passage when the switch wheel is in the second position.

5. The sprinkler apparatus of claim 1 wherein the switch wheel is rotatable from a first position to a second position, wherein the switch wheel generates the first fluid flow when in the first position and generates the second fluid flow when in the second position.

6. The sprinkler apparatus of claim 5 further comprising a catch moveable between a first catch position and a second catch position, wherein the catch is configured to retain the switch wheel in the first position when the catch is in the first catch position and wherein the catch is configured to retain the switch wheel in the second position when the catch is in the second catch position.

7. The sprinkler apparatus of claim 5 wherein the switch wheel is configured to rotate in the same direction when moving from the first position to the second position as when moving from the second position to the first position.

8. The sprinkler apparatus of claim 1 wherein the water spray member comprises a water tube configured to oscillate between the first spray member direction and the second spray member direction.

9. A sprinkler comprising:

a spray member configured to oscillate between a first position and a second position;

a turbine configured to rotate in a first direction and in a second direction, wherein rotation of the turbine in the first direction drives the spray member toward the first position and rotation of the turbine in the second direction drives the spray member toward the second position;

an inlet chamber configured to receive a flow of fluid;

a partition provided between the turbine and the inlet chamber, the partition including a first port and a second port, wherein the first port is configured such that fluid flowing through the first port drives the turbine in the first direction, wherein the second port is configured such that fluid flowing through the second port drives the turbine in the second direction; and a switch positioned in the inlet chamber, the switch moveable between a first switch position and a second switch position, wherein the switch blocks fluid from flowing through the second port when the switch is in the first position and the switch blocks fluid from flowing through the first port when the switch is in the second position, wherein the switch comprises a rotatable wheel including a plurality of vanes and wherein the inlet chamber is configured to channel fluid toward the rotatable wheel such that the force of the fluid on the wheel causes the wheel to rotate in only one direction.

10. A sprinkler comprising:

a rotatable switch member including a plurality of vanes configured to receive a flow of fluid and rotate the switch member from a first position to a second position;

a turbine configured to rotate in a first rotational direction and a second rotational direction;

a first port and a second port positioned between the switch member and the turbine, wherein fluid flowing to the switch member passes through the first port when the switch member is in the first position and through the second port when the switch member is in the second position, and wherein the turbine rotates in the first rotational direction when fluid passes through the first port and in the second rotational direction when fluid passes through the second port; and a spray member comprising at least one fluid outlet, the spray member moveable between a first spray position and a second spray position, wherein the turbine drives the spray member toward the first spray position when the turbine rotates in the first rotational direction and drives the spray member toward the second spray position when the turbine rotates in the second rotational direction.

11. The sprinkler of claim 10 further comprising a fluid inlet configured to direct fluid to the switch member such that the switch member is driven in a single direction by fluid passing through the fluid inlet.

12. The sprinkler of claim 11 further comprising a catch, wherein the catch is movable between a first catch position and a second catch position, wherein the catch is configured to retain the switch member in the first position when the catch is in the first catch position, and wherein the catch is configured to retain the switch member in the second position when the catch is in the second catch position.

13. The sprinkler of claim 12 wherein the catch is operably connected to a moveable trip arm, wherein the trip arm moves the catch to the first catch position when the spray member is in the first spray position and wherein the trip arm moves the catch to the second catch position when the spray member is in the second spray position.

14. The sprinkler of claim 13 wherein the fluid inlet comprises a curved channel and a garden hose coupling, the curved channel configured to receive fluid passing through the garden hose coupling and direct the fluid to the switch member.

15. The sprinkler of claim 10 wherein the spray member is operably connected to the turbine through a drive train comprising a plurality of gears.

16. The sprinkler of claim 10 wherein the first port and the second port are provided in a wall separating the switch member from the turbine.

17. The sprinkler of claim 10 wherein the switch member blocks fluid from passing through the second port when the switch wheel is in the first position and blocks fluid from passing through the first port when the switch wheel is in the second position.

18. The sprinkler of claim 10 wherein the switch member includes a first surface configured to cover the first passage when the switch member is in the second position and wherein the switch member includes a second surface configured to cover the second passage when the switch member is in the first position.

* * * * *